US008535862B2

(12) United States Patent
Iwamoto et al.

(10) Patent No.: US 8,535,862 B2
(45) Date of Patent: Sep. 17, 2013

(54) ELECTROPHOTOGRAPHIC PHOTORECEPTOR, IMAGE FORMING APPARATUS, AND PROCESS CARTRIDGE

(75) Inventors: Takafumi Iwamoto, Shizuoka (JP); Naohiro Toda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 137 days.

(21) Appl. No.: 13/153,883

(22) Filed: Jun. 6, 2011

(65) Prior Publication Data

US 2012/0008978 A1 Jan. 12, 2012

(30) Foreign Application Priority Data

Jul. 7, 2010 (JP) ..... 2010-154517

(51) Int. Cl.
*G03G 5/147* (2006.01)

(52) U.S. Cl.
USPC ..... 430/66; 430/58.7; 399/159

(58) Field of Classification Search
USPC ..... 430/58.7, 66; 399/159
See application file for complete search history.

(56) References Cited

U.S. PATENT DOCUMENTS

| | | | | |
|---|---|---|---|---|
| 3,954,568 | A | 5/1976 | DuPree | |
| 2005/0003287 | A1* | 1/2005 | Kawamura et al. | 430/96 |
| 2011/0159419 | A1* | 6/2011 | Iwamoto et al. | 430/56 |
| 2011/0300474 | A1* | 12/2011 | Nonaka et al. | 430/56 |

FOREIGN PATENT DOCUMENTS

| | | |
|---|---|---|
| JP | 52-36016 | 9/1977 |
| JP | 53-95033 | 8/1978 |
| JP | 53-132347 | 11/1978 |
| JP | 53-133445 | 11/1978 |
| JP | 54-2129 | 1/1979 |
| JP | 54-12742 | 1/1979 |
| JP | 54-14967 | 2/1979 |
| JP | 54-17733 | 2/1979 |
| JP | 54-21728 | 2/1979 |
| JP | 54-22834 | 2/1979 |
| JP | 2000-284514 | 10/2000 |
| JP | 2000-284515 | 10/2000 |
| JP | 3164426 | 3/2001 |
| JP | 2001-125286 | 5/2001 |
| JP | 3194392 | 6/2001 |
| JP | 2001-194813 | 7/2001 |
| JP | 2001-324857 | 11/2001 |
| JP | 2002-6526 | 1/2002 |
| JP | 3273258 | 2/2002 |
| JP | 2003-302779 | 10/2003 |
| JP | 2007-178815 | 7/2007 |
| JP | 4020514 | 10/2007 |
| JP | 2008-139824 | 6/2008 |
| JP | 4148505 | 7/2008 |
| JP | 4173352 | 8/2008 |
| JP | 2008-233893 | 10/2008 |
| JP | 4194973 | 10/2008 |
| JP | 4223671 | 11/2008 |
| JP | 4266859 | 2/2009 |
| JP | 4300279 | 5/2009 |
| JP | 4401599 | 11/2009 |
| JP | 4663916 | 1/2011 |
| WO | WO 2007/020901 A1 | 2/2007 |

* cited by examiner

*Primary Examiner* — Peter Vajda
(74) *Attorney, Agent, or Firm* — Oblon, Spivak, McClelland, Maier & Neustadt, L.L.P.

(57) ABSTRACT

An electrophotographic photoreceptor including a conductive substrate, a photosensitive layer located overlying the conductive substrate, and a hardened protective layer located overlying the photosensitive layer. The hardened protective layer comprises a hardened material of a hardenable composition comprising a radical-polymerizable compound (A) having a charge transport structure and a radical-polymerizable compound (B) having an adamantane skeleton.

10 Claims, 3 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

The present patent application claims priority pursuant to 35 U.S.C. §119 from Japanese Patent Application No. 2010-154517, filed on Jul. 7, 2010, which is hereby incorporated by reference herein in its entirety.

BACKGROUND

1. Field of the Invention

The present invention relates to an electrophotographic photoreceptor, and an image forming apparatus and process cartridge using the electrophotographic photoreceptor.

2. Description of the Background

Organic photoreceptors are more widely used than inorganic photoreceptors in electrophotography recently. This is because a wide variety of environmentally-friendly organic materials responsive to either visible light or infrared light are easily available at low cost. However, organic photoreceptors generally have poor mechanical durability. Therefore, organic photoreceptors are required to have better mechanical durability as well as a long lifespan.

In a typical electrophotographic image forming apparatus, a photoreceptor is charged by a charger ("charging process"), an electrostatic latent image is formed on the charged photoreceptor, the electrostatic latent image is developed into a toner image ("developing process"), the toner image is transferred onto a transfer material ("transfer process"), and residual toner particles remaining on the photoreceptor without being transferred are removed ("cleaning process").

The surface of the photoreceptor is chemically and physically damaged by repeated exposure to the above processes of charging, developing, transfer, and cleaning. The deteriorated photoreceptor produces poor quality image. Thus, there have been various attempts to improve mechanical durability of photoreceptors by providing a protective layer on their surfaces.

For example, Japanese Patent Application Publication No. (hereinafter "JP-A") 2002-139859 describes an electrophotographic photoreceptor having a protective layer dispersing a filler. JP-2001-125286-A and JP-2001-324857-A each describe a photoreceptor having a protective layer having a high hardness. JP-2003-098708-A also describes a photoreceptor having a high hardness. As another example, JP-05-181299-A, JP-2002-006526-A, and JP-2002-082465-A each propose a protective layer including a thermosetting resin. JP-2000-284514-A, JP-2000-284515-A, and JP-2001-194813-A each propose a protective layer including a siloxane resin having a charge transportable group. Japanese Patent No. (hereinafter "JP") 3194392 proposes a charge transport layer obtained from a monomer having a C=C double bond, a charge transport material having a C=C double bond, and a binder resin. JP-2004-302451-A proposes a charge transport layer obtained by curing a tri- or more functional non-charge-transportable radical-polymerizable monomer with a monofunctional charge-transportable radical-polymerizable compound. JP-2005-99688-A proposes a protective layer obtained by curing a tri- or more functional non-charge-transportable radical-polymerizable monomer with a charge-transportable radical-polymerizable compound, and dispersing a filler.

However, the lifespan is not necessarily extended only by improving mechanical durability. To extend the lifespan, photoreceptors are further required not to be adhesive to foreign substances and to be able to transfer toner at high efficiency.

First, why photoreceptors are required not to be adhesive to foreign substances is described below. Even a photoreceptor having high mechanical durability may produce defective images after a long period of use due to adhesion of foreign substances (e.g., paper powder or external additives released from toner), which prevents the photoreceptor from being normally exposed to charging and light irradiation. On the other hand, a photoreceptor having poor mechanical durability is unlikely to produce defective image even when foreign substances are adhered, because the substances can be removed along abrasion of the outermost surface. But such abrasion may adversely affect the lifespan of the photoreceptor. Thus, photoreceptors are required not to be adhesive to foreign substances.

Next, why photoreceptors are required to be able to transfer toner at high efficiency is described below. A photoreceptor which can transfer toner at high efficiency do not waste toner. When a large amount of toner particles are remaining on a photoreceptor without being transferred onto a recording medium, the photoreceptor may be excessively stressed with the action of a cleaning member, resulting in a short lifespan of the photoreceptor. Thus, photoreceptors are required to be able to transfer toner at high efficiency.

When a photoreceptor is non-adhesive to foreign substances and able to transfer toner at high efficiency simultaneously, it may be said that the photoreceptor has repellency. Repellency is effectively given to a photoreceptor by reducing the outermost surface energy. The surface energy can be reduced by applying an external low-surface-energy material to the photoreceptor or including an internal low-surface-energy material in the photoreceptor. For example, zinc stearate is usable as the external low-surface-energy material. The external low-surface-energy material can be applied from an application mechanism provided around the photoreceptor. However, there is a possibility that the external low-surface-energy material is deteriorated by electric discharge and defective image is produced thereby. Moreover, provision of the application mechanism limits the layout of image forming parts and raises the cost. As an example of using an internal low-surface-energy material, JP-2007-178815-A describes a photoreceptor including a fluorine-substituted polysiloxane resin in a surface layer. It is known that siloxane bonds polarize to form hydrogen bonds. Therefore, such a photoreceptor gets more adhesive to toner and degrades its repellency under high-humidity conditions. Undesirably, such a photoreceptor should be constantly abraded so that the internal low-surface-energy material is constantly exposed at the surface of the photoreceptor, sacrificing mechanical durability.

It is important, but is difficult, to satisfy both mechanical durability and repellency. JP-2002-6526-A describes a photoreceptor having a protective layer including lubricative fine particles. JP-2008-139824-A describes a photoreceptor having a fluorine-based hardened surface protective layer. JP-2008-233893-A describes a photoreceptor having a fluorine-based cross-linked surface layer and a protective layer including lubricative fine particles. Fluorine-based materials are effective for reducing adhesive force between photoreceptor and toner. A hardened protective layer including a fluorine-based material is effective for both improving mechanical durability and reducing adhesive force between photoreceptor and toner. But it requires a substantial amount of fluorine-based materials to sufficiently reduce the adhesive force between photoreceptor and toner. A substantial amount of fluorine-based materials may undesirably increase bright section potential and degrade film strength.

JP-2003-302779-A describes a photoreceptor having a surface layer comprising a specific resin having norbornene rings and a charge transport material. Because the resin is not cross-linked, the surface layer has poor mechanical strength a short lifespan. It is still difficult to provide a photoreceptor having a good combination of mechanical durability and high repellency.

SUMMARY

Exemplary aspects of the present invention are put forward in view of the above-described circumstances, and provide a novel electrophotographic photoreceptor, image forming apparatus, and process cartridge having a good combination of mechanical durability and high repellency, which can be used for an extended period of time without degrading image quality.

In one exemplary embodiment, a novel electrophotographic photoreceptor includes a conductive substrate, a photosensitive layer located overlying the conductive substrate, and a hardened protective layer located overlying the photosensitive layer. The hardened protective layer comprises a hardened material of a hardenable composition comprising a radical-polymerizable compound (A) having a charge transport structure and a radical-polymerizable compound (B) having an adamantane skeleton.

In another exemplary embodiment, a novel image forming apparatus or process cartridge includes the above electrophotographic photoreceptor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
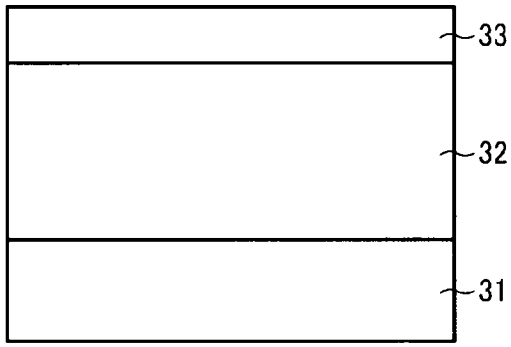
FIG. 1 is a cross-sectional view illustrating an electrophotographic photoreceptor according to exemplary aspects of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Within the context of the present invention, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

FIG. 1 is a cross-sectional view illustrating an electrophotographic photoreceptor according to exemplary aspects of the invention. A multilayer photoreceptor illustrated in FIG. 1 includes, from the innermost side thereof, a conductive substrate 31, a photosensitive layer 32, and a hardened protective layer 33.

The conductive substrate 31 may be comprised of a conductive material having a volume resistivity not greater than $10^{10}$ Ω·cm. For example, plastic films, plastic cylinders, or paper sheets, on the surface of which a metal (such as aluminum, nickel, chromium, nichrome, copper, gold, silver, platinum, and the like, or a metal oxide such as tin oxide, and indium oxide) is formed by deposition or sputtering, can be used as the conductive substrate 31. Additionally, a metal cylinder which is prepared by tubing a metal (such as aluminum, aluminum alloy, nickel, and stainless steel) by drawing ironing, impact ironing, extruded ironing, and extruded drawing, and then treating the surface of the tube by cutting, super finishing, polishing, and the like treatments, can be also used as the conductive substrate 31. In addition, an endless nickel belt disclosed in Examined Japanese Application Publication No. S52-36016, the disclosures thereof being incorporated herein by reference, and an endless stainless belt can be also used as the conductive substrate 31.

Further, the above-described conductive substrates on which a conductive layer dispersing a conductive powder in a binder resin is formed can also be used as the conductive substrate 31. Specific examples of usable conductive powders include, but are not limited to, carbon black, acetylene black, powders of metals such as aluminum, nickel, iron, nichrome, copper, zinc, and silver, and powders of metal oxides such as conductive tin oxides and ITO.

Specific examples of usable binder resins include thermoplastic, thermosetting, and photo-crosslinking resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. Such a conductive layer can be formed by coating a coating liquid in which a conductive powder and a binder resin are dispersed or dissolved in a solvent such as tetrahydrofuran, dichloromethane, methyl ethyl ketone, and toluene, and then drying the coated liquid.

In addition, cylindrical substrates, on the surface of which a conductive layer is formed with a heat-shrinkable tube which is dispersing a conductive powder in a resin such as polyvinyl chloride, polypropylene, polyester, polystyrene, polyvinylidene chloride, polyethylene, chlorinated rubber, and polytetrachloroethylene-based fluororesin, can also be used as the conductive substrate 31.

The photosensitive layer 32 may be either single-layered or multilayered. The multilayered photosensitive layer 32 comprises a charge generation layer and a charge transport layer.

The charge generation layer includes a charge generation material as a main component, and optionally includes a binder resin.

Specific examples of usable charge generation materials include, but are not limited to, azo pigments such as monoazo pigments, disazo pigments, asymmetric disazo pigments, trisazo pigments, azo pigments having a carbazole skeleton (described in JP-S53-95033-A), azo pigments having a distyrylbenzene skeleton (described in JP-S53-133445-A), azo pigments having a triphenylamine skeleton (described in JP-S53-132347-A), azo pigments having a diphenylamine skeleton, azo pigments having a dibenzothiophene skeleton (described in JP-S54-21728-A), azo pigments having a fluorenone skeleton (described in JP-S54-22834-A), azo pigments having an oxadiazole skeleton (described in JP-S54-12742-A), azo pigments having a bisstilbene skeleton (described in JP-S54-17733-A), azo pigments having a distyryloxadiazole skeleton (described in JP-S54-2129-A), and azo pigments having a distyrylcarbazole skeleton (described in JP-S54-14967-A); azulenium salt pigments, squaric acid methine pigments, perylene pigments, anthraquinone and polycyclic quinone pigments, quinone imine pigments, diphenylmethane and triphenylmethane pigments, benzoquinone and naphthoquinone pigments, cyanine and azomethine pigments, benzoquinone and naphthoquinone pigments, cyanine and azomethine pigments, indigoid pigments, bisbenzimidazole pigments, and phthalocyanine pigments such as metal phthalocyanine and metal-free phthalocyanine. The disclosures of the above-cited references are incorporated herein by reference. Two or more of these charge generation materials can be used in combination.

Specific examples of binder resins optionally included in the charge generation layer include, but are not limited to, polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. Two or more of these binder resins can be used in combination. The content of the binder resin is preferably 0 to 500 parts by weight, and more preferably 10 to 300 parts by weight, based on 100 parts by weight of the charge generation material.

Specific examples of usable solvents for the charge generation layer coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferable. Two or more of these solvents can be used in combination.

The charge generation layer coating liquid can be prepared by dispersing a charge generation material, optionally along with a binder resin, in a solvent using a ball mill, an attritor, a sand mill, a bead mill, or an ultrasonic disperser. The binder resin may be added to the charge generation layer coating liquid either before or after the charge generation material is dispersed therein. The charge generation layer coating liquid includes the charge generation material, the solvent, and the optional binder resin as main components, and may further include additives such as an intensifier, a dispersant, a surfactant, and a silicone oil. The charge generation layer may further include a charge transport material, to be described in later. The content of the binder resin is preferably 0 to 500 parts by weight, and more preferably 10 to 300 parts by weight, based on 100 parts by weight of the charge generation material.

The charge generation layer can be formed by coating a conductive substrate or an undercoat layer with the charge generation layer coating liquid, followed by drying. Suitable coating methods include, but are not limited to, a dip coating method, a spray coating method, a bead coating method, a nozzle coating method, a spinner coating method, and a ring coating method. The charge generation layer preferably has a thickness of 0.01 to 5 μm, and more preferably 0.1 to 2 μm. The charge generation layer coating liquid is dried by application of heat using an oven, for example. The drying temperature is preferably 50 to 160° C., and more preferably 80 to 140° C.

The charge transport layer includes a charge transport material as a main component, and optionally includes a binder resin. The charge transport material includes a hole transport material, and optionally includes an electron transport material. Both the hole transport material and the electron transport material function as the charge transport material.

Specific preferred examples of suitable electron transport materials include, but are not limited to, electron-accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, diphenoquinone derivatives, and naphthalene tetracarboxylic acid diimide derivatives. Two or more of these electron transport materials can be used in combination.

Specific preferred examples of suitable hole transport materials include, but are not limited to, poly-N-vinylcarbazole and derivatives thereof, poly-γ-carbazolylethyl glutamate and derivatives thereof, pyrene-formaldehyde condensates and derivatives thereof, polyvinyl pyrene, polyvinyl phenanthrene, polysilane, oxazole derivatives, oxadiazole derivatives, imidazole derivatives, monoarylamine derivatives, diarylamine derivatives, stilbene derivatives, α-phenylstilbene derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, distyryl derivatives, and enamine derivatives. Two or more of these hole transport materials can be used in combination. In particular, charge transport materials having a triarylamine structure are advantageous in transporting charges.

Specific examples of usable binder resins include thermoplastic and thermosetting resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The content of the charge transport material is preferably 20 to 300 parts by weight, and more preferably 40 to 150 parts by weight, based on 100 parts by weight of the binder resin.

Specific examples of usable solvents for a charge transport layer coating liquid include, but are not limited to, tetrahydrofuran, dioxane, toluene, dichloromethane, monochlorobenzene, dichloroethane, cyclohexanone, methyl ethyl ketone, and acetone. Two or more of these solvents can be used in combination.

The charge transport layer may further include a plasticizer and/or a leveling agent. Specific examples of plasticizers suitable for the charge transport layer include, but are not limited to, dibutyl phthalate and dioctyl phthalate. The content of the plasticizer is preferably 0 to 30 parts by weight based on 100 parts by weight of the binder resin. Specific examples of leveling agents suitable for the charge transport layer include, but are not limited to, silicone oils such as dimethyl silicone oil and methyl phenyl silicone oil, and polymers or oligomers having a perfluoroalkyl-group-containing side chain. The content of the leveling agent is preferably 0 to 1 part by weight based on 100 parts by weight of the binder resin.

The thickness of the charge transport layer is preferably 30 μm or less, more preferably 25 μm or less, from the viewpoint of image resolution and responsiveness, and 5 μm or more.

As described above, the photosensitive layer 32 may be either single-layered or multilayered. The single-layered photosensitive layer 32 can be formed by coating a conductive substrate or an undercoat layer with a photosensitive layer coating liquid dissolving or dispersing a charge generation material, a charge transport material, a binder resin in a solvent, followed by drying. The above-described specific charge generation materials and charge transport materials (i.e., electron transport materials and charge transport materials) suitable for the charge generation layer and the charge transport layer, respectively, can also be used for the single-layered photosensitive layer 32. The above-described specific binder resins suitable for the charge generation layer and the charge transport layer can also be used for the single-layered photosensitive layer 32. The content of the charge generation material is preferably 5 to 40 parts by weight, more preferably 10 to 30 parts by weight, based on 100 parts by weight of the binder resin. The content of the charge transport material is preferably 0 to 190 parts by weight, more preferably 50 to 150 parts by weight, based on 100 parts by weight of the binder resin. The photosensitive layer coating liquid can be prepared by dissolving or dispersing the charge generation material, the charge transport material, and the binder resin in a solvent such as tetrahydrofuran, dioxane, dichloroethane, cyclohexanone, toluene, methyl ethyl ketone, and acetone. Suitable coating methods include, but are not limited to, a dip coating method, a spray coating method, a bead coating method, and a ring coating method. The photosensitive layer may further include additives such as a plasticizer, a leveling agent, an antioxidant, and a lubricant. The photosensitive layer preferably has a thickness of 5 to 25 μm.

The hardened protective layer 33 comprises a hardened material of a hardenable composition comprising a radical-polymerizable compound (A) having a charge transport structure and a radical-polymerizable compound (B) having an adamantane skeleton.

More preferably, the hardened protective layer 33 comprises a hardened material of a hardenable composition comprising a radical-polymerizable compound (A) having a charge transport structure, a radical-polymerizable compound (B) having an adamantane skeleton, and a tri- or more functional radical-polymerizable compound (C). The hardened protective layer 33 may further include another resin or precursor thereof, such as an epoxy compound and a polyisocyanate compound, other than the hardened material. The amount of the resin or precursor is preferably 150 parts by weight or less, more preferably 130 parts by weight or less, based on 100 parts by weight of the radical-polymerizable compounds (A), (B), and (C) in total.

Generally, hardening is defined as a reaction that forms a three-dimensional network structure upon application of energy such as heat, light, and electron beam to polyfunctional low-molecular-weight compounds or polymeric compounds, so that the polyfunctional low-molecular-weight compounds or polymeric compounds form intermolecular bonds, such as covalent bonds.

The radical-polymerizable compound (B) having an adamantane skeleton is described in detail below.

Adamantane consists of four cyclohexane rings that are condensed into a basket shape. Adamantane is a stable skeleton having high symmetry.

An adamantane skeleton can be obtained from isomerization of trimethylene norbornane (tetrahydro dicyclopentadiene), perhydro acenaphthene, perhydro fluorene, perhydro phenalene, 1,2-cyclopentano perhydro naphthalene, perhydro anthracene, perhydro phenanthrene, or alkyl substitutions thereof, such as 9-methyl perhydro anthracene, as described in JP-2002-302462-A, the disclosures thereof being incorporated herein by reference.

The radical-polymerizable compound (B) is defined as a compound (e.g., a monomer) having either an adamantane skeleton or a radical-polymerizable functional group, but having neither hole transport structure (e.g., triarylamine, hydrazone, pyrazoline, and carbazole) nor electron transport structure (e.g., condensed polycyclic quinone, diphenoquinone, electron-attracting aromatic rings having cyano group or nitro group). The radical-polymerizable functional group in the radical-polymerizable compound (B) having an adamantane skeleton is preferably acryloyl group, from the viewpoint of reactivity. The radical-polymerizable compound (B) having an adamantane skeleton is preferably monofunctional or difunctional, from the viewpoint of abrasion resistance and repellency of the resulting layer. Preferably, the radical-polymerizable compound (B) has a single adamantane skeleton, from the viewpoint of compatibility with other materials and uniformity of the resulting layer.

The radical-polymerizable compound (B) having an adamantane skeleton can be obtained by azeotropic dehydration of an alcohol having an adamantane skeleton (e.g., 1-adamantanol, 1,3-adamantanediol, 1-adamantanemethanol, 1,3-adamantanedimethanol, 1-adamantaneethanol, 1,3-adamantanediethanol) with an acrylic acid or a methacrylic acid under solvent reflux. A hydrogen atom in the adamantane skeleton of the radical-polymerizable compound (B) may be substituted with a fluorine atom by azeotropic dehydration of a perfluoro adamantanol with an acrylic acid or a methacrylic acid under solvent reflux, as described in JP-2004-123687-A, the disclosures thereof being incorporated herein by reference. Specific examples of usable perfluoro adamantanols include, but are not limited to, perfluoro-1-adamantanol, perfluoro-1,3-adamantanediol, perfluoro-1-adamantanemethanol, perfluoro-1,3-adamantanedimethanol, perfluoro-1-adamantaneethanol, perfluoro-1,3-adamantanediethanol, 1-(2-hydroxyethoxy) perfluoro adamantane, and 1,3-bis(2-hydroxyethoxy) perfluoro adamantane. Suitable reaction solvents for the azeotropic dehydration include toluene and xylene, for example.

In the azeotropic dehydration, the reaction temperature is preferably set to the boiling point of the solvent at the reaction pressure, for example, −78 to 200° C. The reaction pressure is preferably 0.1 to 10 MPa. The reaction time is preferably 1 to 24 hours, more preferably 3 to 6 hours. The concentration of raw materials dissolved in the reaction solvent is within the saturated solubility, preferably 0.5 to 1.0 mol/l.

The electrophotographic photoreceptor according to the present invention has a good combination of mechanical durability and repellency owing to rigidity and lubricity of the adamantane skeleton. Because of including no internal lubricant, the electrophotographic photoreceptor according to the present invention can keep reliable photosensitivity while avoiding abrasion because it needs not expose a fresh surface to deposit internal lubricant. An adamantane skeleton having a fluorine atom has better repellency due to synergistic effect of the adamantane skeleton and high repellency of fluorine atom.

As described above, the hardened protective layer 33 may include a hardened material of a hardenable composition comprising the radical-polymerizable compound (A) having a charge transport structure, the radical-polymerizable compound (B) having an adamantane skeleton, and the tri- or more functional radical-polymerizable compound (C).

The weight ratio of the radical-polymerizable compound (B) having an adamantane skeleton to the total of the radical-polymerizable compound (B) having an adamantane skeleton and the tri- or more functional radical-polymerizable compound (C) is preferably 0.2 to 0.9. When the weight ratio of the radical-polymerizable compound (B) having an adamantane skeleton is too small, the hardened protective layer 33 may have poor repellency because the content of adamantane is too small. When the weight ratio of the radical-polymerizable compound (B) having an adamantane skeleton is too large, the hardened protective layer 33 may have poor abrasion resistance because the layer has low cross-linking density. To achieve a good combination of repellency and abrasion resistance, it is preferable that the weight ratio of the radical-polymerizable compound (B) having an adamantane skeleton to the total of the radical-polymerizable compound (B) having an adamantane skeleton and the tri- or more functional radical-polymerizable compound (C) is 0.2 to 0.9.

Specific preferred examples of the radical-polymerizable compound (B) having an adamantane skeleton are shown below, but are not limited thereto.

Adamantan e-1

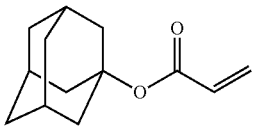

Adamantan e-2

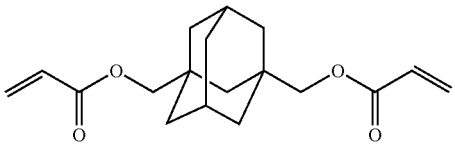

Adamantan e-3

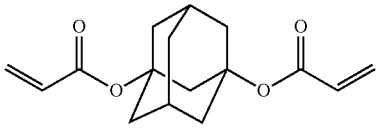

Adamantan e-4

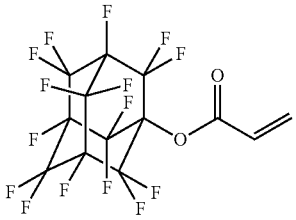

Adamantan e-5

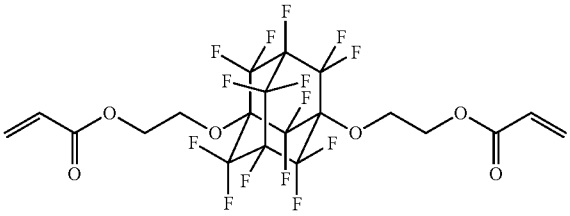

-continued

Adamantan e-6

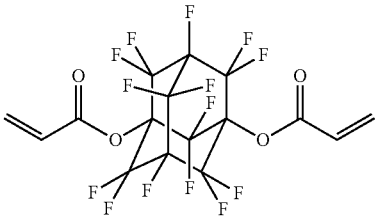

The tri- or more functional radical-polymerizable compound (C) may be, for example, a reactive compound which can be a raw material of a heat-curable resin, a photocurable resin, or an electron-curable resin, and it can be used in combination with a curing agent, a catalyst, or a polymerization initiator.

Such reactive compounds (e.g., monomer, oligomer) have a polymerizable functional group. The polymerizable functional group may be, for example, an acryloyl group or a methacryloyl group. One molecule of the reactive compound preferably includes 3 or more functional groups to obtain a more rigid three-dimensional network structure. More preferably, the ratio of the molecular weight to the number of functional groups is 250 or less. In that case, the resulting layer has high hardness, elasticity, and smoothness. Thus, the resulting photoreceptor provides high repellency, durability, and image quality.

The photoreceptor according to the present invention includes the conductive substrate 31, the photosensitive layer 32, and the hardened protective layer 33 having a three-dimensional network structure formed by hardening the radical-polymerizable compound (A) having a charge transport structure, the radical-polymerizable compound (B) having an adamantane skeleton, and the optional tri- or more functional radical-polymerizable compound (C). When a hardening agent, a catalyst, or a polymerization initiator is previously mixed with the radical-polymerizable compounds, unreacted functional groups are reduced and the degree of hardening is more improved. Thus, the hardened protective layer 33 is given better abrasion resistance without degrading electrostatic property. Additionally, the resulting layer is more resistant to crack and deformation, because the hardening reaction takes place uniformly.

The tri- or more functional radical-polymerizable compound (C) is defined as a compound (e.g., a monomer) having a radical-polymerizable functional group, but having none of hole transport structure (e.g., triarylamine, hydrazone, pyrazoline, and carbazole), electron transport structure (e.g., condensed polycyclic quinone, diphenoquinone, electron-attracting aromatic rings having cyano group or nitro group), and adamantane skeleton.

The radical-polymerizable functional group has a carbon-carbon double bond. Specific examples of the radical-polymerizable functional group include, but are not limited to, 1-substituted ethylene functional groups and 1,1-substituted ethylene functional groups.

The 1-substituted ethylene functional groups are represented by the following formula (1):

$$CH_2{=}CH{-}X_1{-} \quad (1)$$

wherein $X_1$ represents an arylene group (e.g., phenylene group, naphthylene group) which may have a substituent, an alkenylene group which may have a substituent, —CO—, —COO—, or —$CONR_{78}$ ($R_{78}$ represents a hydrogen atom, an alkyl group (e.g., methyl group, ethyl group), an aralkyl group (e.g., benzyl group, naphthyl methyl group, phenethyl group), an aryl group (e.g., phenyl group, naphthyl group), or —S—).

Specific examples of functional groups represented by the formula (1) include, but are not limited to, vinyl group, styryl group, 2-methyl-1,3-butadienyl group, vinyl carbonyl group, acryloyloxy group, acryloylamide group, and vinyl thioether group.

The 1,1-substituted ethylene functional groups are represented by the following formula (2):

$$CH_2=CY—X_2 \quad (2)$$

wherein Y represents an alkyl group which may have a substituent, an aralkyl group which may have a substituent, an aryl group (e.g., phenyl group, naphthyl group) which may have a substituent, a halogen atom, a cyano group, a nitro group, an alkoxy group (e.g., methoxy group, ethoxy group), —$COOR_{79}$ ($R_{79}$ represents a hydrogen atom, an alkyl group (e.g., methyl group, ethyl group) which may have a substituent, an aralkyl group (e.g., benzyl group, phenethyl group) which may have a substituent, an aryl group (e.g., phenyl group, naphthyl group) which may have a substituent), or —$CONR_{80}R_{81}$ (each of $R_{80}$ and $R_{81}$ independently represents a hydrogen atom, an alkyl group (e.g., methyl group, ethyl group) which may have a substituent, an aralkyl group (e.g., benzyl group, naphthyl methyl group, phenethyl group) which may have a substituent, or an aryl group (e.g., phenyl group, naphthyl group) which may have a substituent); $X_2$ represents a group represented by $X_1$ in the formula (1), a single bond, or an alkylene group; and at least one of Y and $X_2$ represents an oxycarbonyl group, a cyano group, an alkenylene group, or an aromatic ring.

Specific examples of functional groups represented by the formula (2) include, but are not limited to, α-chlorinated acryloyloxy group, methacryloyloxy group, α-cyanoethylene group, α-cyanoacryloyloxy group, α-cyanophenylene group, or methacryloylamino group.

$X_1$, $X_2$, and Y may have a substituent such as a halogen atom, a nitro group, a cyano group, an alkyl group (e.g., methyl group, ethyl group), an alkoxy group (e.g., methoxy group, ethoxy group), an aryloxy group (e.g., phenoxy group), an aryl group (e.g., phenyl group, naphthyl group), or an aralkyl group (e.g., benzyl group, phenethyl group).

Preferably, the radical-polymerizable functional group is an acryloyloxy group or a methacryloyloxy group. The number of functional groups is preferably as large as possible. The tri- or more functional radical-polymerizable compound (C) forms a three-dimensional network structure having high cross-linking density, hardness, and elasticity. Thus, the resulting layer is uniform and smooth, and has high abrasion resistance and scratch resistance. Depending on hardening conditions or the kind of materials in use, a number of chemical bonds may be instantaneously formed. In such cases, crack or peeling is likely to occur in the resulting layer due to internal stress generated by volume contraction. This problem can be solved by using a monofunctional and/or difunctional radical-polymerizable compound.

A compound having an acryloyloxy group can be obtained from an esterification reaction or an ester exchange reaction between a compound having a hydroxyl group and an acrylate, acrylic halide, or acrylic ester. A compound having a methacryloyloxy group can be obtained from an esterification reaction or an ester exchange reaction between a compound having a hydroxyl group and a methacrylate, methacrylic halide, or methacrylic ester. Each of multiple radical-polymerizable functional groups may be either the same or different. To form dense cross-linking bonds in the hardened protective layer 33, the ratio of the molecular weight to the number of functional groups of the tri- or more functional radical-polymerizable compound (C) is preferably 250 or less. When the ratio is too large, the resulting hardened protective layer 33 may be too soft and have low abrasion resistance. Therefore, it is not preferable that a compound having an extremely long modification group, such as ethylene oxide, propylene oxide, and caprolactone, is used alone.

Specific preferred examples of suitable tri- or more functional radical-polymerizable compounds (C) include, but are not limited to, trimethylolpropane triacrylate (TMPTA), trimethylolpropane trimethacrylate, trimethylolpropane alkylene-modified triacrylate, trimethylolpropane ethyleneoxy-modified (hereinafter "EO-modified") triacrylate, trimethylolpropane propyleneoxy-modified (hereinafter "PO-modified") triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified (hereinafter "ECH-modified") triacrylate, glycerol EO-modified triacrylate, glycerol PO-modified triacrylate, tris(acryloxyethyl) isocyanurate, dipentaerythritol hexaacrylate (DPHA), dipentaerythritol caprolactone-modified hexaacrylate, dipentaerythritol hydroxypentaacrylate, alkylated dipentaerythritol pentaacrylate, alkylated dipentaerythritol tetraacrylate, alkylated dipentaerythritol triacrylate, ditrimethylolpropane tetraacrylate (DTMPTA), pentaerythritol ethoxytetraacrylate, phosphoric acid EO-modified triacrylate, and 2,2,5,5-tetrahydroxymethylcyclopentanone tetraacrylate. Two or more of these compounds can be used in combination.

The radical-polymerizable compound (A) having a charge transport structure is defined as a compound having a radical-polymerizable functional group, and a hole transport structure (e.g., triarylamine, hydrazone, pyrazoline, and carbazole) or an electron transport structure (e.g., condensed polycyclic quinone, diphenoquinone, electron-attracting aromatic rings having cyano group or nitro group). The radical-polymerizable functional group has a carbon-carbon double bond.

The number of functional groups in the radical-polymerizable compound (A) having a charge transport structure is not limited to any number. From the viewpoint of mechanical durability, the radical-polymerizable compound (A) having a charge transport structure is preferably monofunctional so that excessive stress is not applied to the layer during hardening. Additionally, a monofunctional radical-polymerizable compound (A) having a charge transport structure results in better charge transportability of the resulting hardened protective layer 33 than that being difunctional. This is because the monofunctional compound causes less molecular strain during hardening.

The charge transport structure in the radical-polymerizable compound (A) is preferably a triarylamine structure that effectively transports charges. Triarylamine structures generally have a n-conjugated system having a lot of hopping sites, and are likely to be conjugated with each other when in radical cation conditions. Therefore, triarylamine structures have high charge transportability. Specifically, the following compounds (3) and (4) can keep good electric properties such as sensitivity and residual potential.

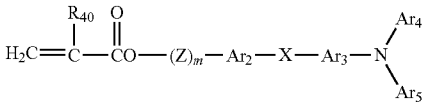

(3)

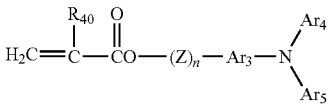

(4)

wherein $R_{40}$ represents a hydrogen atom, a halogen atom, an alkyl group, an aralkyl group, an aryl group, a cyano group, a nitro group, an alkoxy group, —$COOR_{41}$ ($R_{41}$ represents a hydrogen atom, an alkyl group, an aralkyl group, or an aryl group), a halogenated carbonyl group, or —$CONR_{42}R_{43}$ (each of $R_{42}$ and $R_{43}$ independently represents a hydrogen atom, a halogen atom, an alkyl group, an aralkyl group, or an aryl group); each of $Ar_2$ and $Ar_3$ independently represents an arylene group; each of $Ar_4$ and $Ar_5$ independently represents an aryl group; X represents a single bond, an alkylene group, a cycloalkylene group, an alkylene ether group, an oxygen atom, a sulfur atom, or a vinylene group; Z represents an alkylene group, an alkylene ether group, or an alkyleneoxycarbonyl group; and each of n and m independently represents an integer of 0 to 3.

Aralkyl and aryl groups represented by $R_{40}$ may have a substituent. Alkyl, aralkyl, and aryl groups represented by $R_{41}$ may have a substituent. Alkyl, aralkyl, and aryl groups represented by $R_{42}$ or $R_{43}$ may have a substituent. Arylene groups represented by $Ar_2$ or $Ar_3$ may have a substituent. Aryl groups represented by $Ar_4$ or $Ar_5$ may have a substituent. Alkylene, cycloalkylene, and alkylene ether groups represented by X may have a substituent. Alkylene and alkylene ether groups represented by Z may have a substituent.

An alkyl group represented by $R_{40}$ may be, for example, methyl, ethyl, propyl, or butyl group. An aryl group represented by $R_{40}$ may be, for example, phenyl or naphthyl group. An aralkyl group represented by $R_{40}$ may be, for example, benzyl, phenethyl, or naphthyl methyl group. An alkoxy group represented by $R_{40}$ may be, for example, methoxy, ethoxy, or propoxy group. These groups may further have a substituent such as a halogen atom, a nitro group, a cyano group, an alkyl group (e.g., methyl group, ethyl group), an alkoxy group (e.g., methoxy group, ethoxy group), an aryloxy group (e.g., phenoxy group), an aryl group (e.g., phenyl group, naphthyl group), or an aralkyl group (e.g., benzyl group, phenethyl group). Preferably, $R_{40}$ represents a hydrogen atom or methyl group.

Each of $Ar_4$ and $Ar_5$ represents a substituted or unsubstituted aryl group. The aryl group may be, for example, a condensed polycyclic hydrocarbon group, a non-condensed cyclic hydrocarbon group, or a heterocyclic group.

Specific preferred examples of suitable condensed polycyclic hydrocarbon groups include, but are not limited to, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluoranthenyl group, acephenanthrylenyl group, aceanthrylenyl group, triphenylenyl group, pyrenyl group, chrysenyl group, and naphthacenyl group, which are having a cyclic structure formed with 18 or less carbon atoms. Specific preferred examples of suitable non-condensed cyclic hydrocarbon groups include, but are not limited to, monovalent groups of monocyclic hydrocarbon compounds such as benzene, diphenyl ether, polyethylene diphenyl ether, diphenyl thioether, and diphenyl sulfone; monovalent groups of non-condensed polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane, and polyphenylalkene; and monovalent groups of cyclic hydrocarbon compounds such as 9,9-diphenyl fluorene. Specific preferred examples of suitable heterocyclic groups include, but are not limited to, monovalent groups of carbazole, dibenzofuran, dibenzothiophene, oxadiazole, and thiadiazole.

Aryl groups represented by $Ar_4$ or $Ar_5$ may have the following substituent (1) to (8).

(1) A halogen atom, a cyano group, or a nitro group.

(2) An alkyl group. Preferably, a straight-chain or branched-chain alkyl group having carbon atoms in an amount of 1 to 12, more preferably 1 to 8, and most preferably 1 to 4. The alkyl group may have a substituent such as a fluorine atom, a hydroxyl group, a cyano group, a C1-C4 alkoxy group, or a phenyl group. The phenyl group may have a substituent such as a halogen atom, a C1-C4 alkyl group, or a C1-C4 alkoxy group. Specific examples of such alkyl groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-meyhylbenzyl group, and 4-phenylbenzyl group.

(3) An alkoxy group represented by —$OR_{82}$. $R_{82}$ represents an alkyl group described in the paragraph (2). Specific examples of such alkoxy groups include, but are not limited to, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) An aryloxy group derived from an aryl group such as phenyl group and naphthyl group. The aryloxy group may have a substituent such as a C1-C4 alkoxy group, a C1-C4 alkyl group, and a halogen atom. Specific examples of such aryloxy groups include, but are not limited to, phenoxy group, 1-naphthyloxy group, 2-napthyloxy group, 4-methoxyphenoxy group, and 4-methylphenoxy group.

(5) An alkyl mercapto group or an aryl mercapto group, such as methylthio group, ethylthio group, phenylthio group, and p-methylphenylthio group.

(6) A group having the following formula:

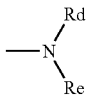

wherein each of Rd and Re independently represents a hydrogen atom, an alkyl group described in the paragraph (2), or an aryl group (e.g., phenyl group, biphenyl group, naphthyl group) which may have a substituent such as a C1-C4 alkoxy group, a C1-C4 alkyl group, and a halogen atom; or Rd and Re may share bond connectivity to form a ring.

Specific examples of the group having the above formula include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) An alkylenedioxy group and an alkylene dithio group, such as methylenedioxy group and methylene dithio group.

(8) A substituted or unsubstituted styryl group, a substituted or unsubstituted β-phenyl styryl group, a diphenyl aminophenyl group, and a ditolyl aminophenyl group.

Arylene groups represented by $Ar_2$ or $Ar_3$ may be, for example, divalent groups derived from aryl groups represented by $Ar_4$ or $Ar_5$.

X represents a single bond, a substituted or unsubstituted alkylene group, a substituted or unsubstituted cycloalkylene group, a substituted or unsubstituted alkylene ether group, an oxygen atom, a sulfur atom, or a vinylene group.

The substituted or unsubstituted alkylene group may be, for example, a straight-chain or branched-chain alkylene group having carbon atoms in an amount of 1 to 12, more preferably 1 to 8, and most preferably 1 to 4. The alkylene group may have a substituent such as a fluorine atom, a hydroxyl group, a cyano group, a C1-C4 alkoxy group, or a phenyl group. The phenyl group may have a substituent such as a halogen atom, a C1-C4 alkyl group, or a C1-C4 alkoxy group. Specific examples of such alkylene groups include, but are not limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-meyhylphenylethylene group, and 4-biphenylethylene group.

The substituted or unsubstituted cycloalkylene group may be, for example, a C5-C7 cyclic alkylene group which may have a substituent such as a fluorine atom, a hydroxyl group, a C1-C4 alkyl group, or a C1-C4 alkoxy group. Specific examples of such cycloalkylene groups include, but are not limited to, cyclohexylidene group, cyclohexylene group, and 3,3-dimethyl cyclohexylidene group.

The substituted or unsubstituted alkylene ether group may be, for example, an alkyleneoxy group (e.g., ethyleneoxy group, propyleneoxy group); an alkylenedioxy group derived from ethylene glycol or propylene glycol; or a di- or poly-(oxyalkylene)oxy group derived from diethylene glycol, tetraethylene glycol, or tripropylene glycol. The alkylene part in the alkylene ether group may have a substituent such as hydroxyl group, methyl group, and ethyl group.

The vinylene group may be, for example, a group having the following formula:

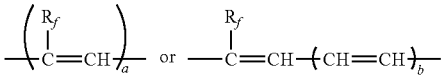

wherein Rf represents a hydrogen atom, an alkyl group described in the above paragraph (2), or an aryl group represented by $Ar_4$ or $Ar_5$; a represents an integer of 1 or 2; and b represents an integer of 1 to 3.

Z represents a substituted or unsubstituted alkylene group, a substituted or unsubstituted alkylene ether group, or an alkyleneoxycarbonyl group.

The substituted or unsubstituted alkylene group may be, for example, those included in X.

The substituted or unsubstituted alkylene ether group may be, for example, those included in X.

The alkyleneoxycarbonyl group may be, for example, a caprolactone-modified group.

More preferably, the radical-polymerizable compound (A) having a charge transport structure is the following compound (5)

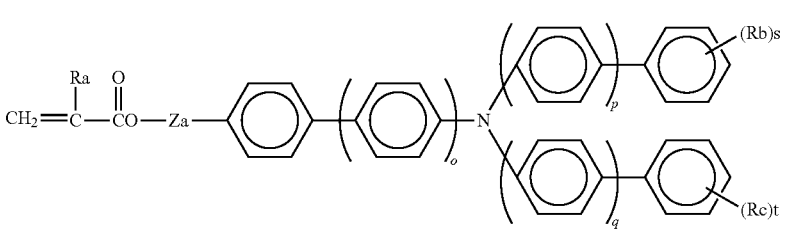

(5)

each of o, p, and q independently represents an integer of 0 or 1; Ra represents a hydrogen atom or methyl group; each of Rb and Rc independently represents an alkyl group having 1 to 6 carbon atoms; multiple Rb or Rc may be, but need not necessarily be, the same; each of s and t independently represents an integer of 0 to 3; and Za represents a single bond, methylene group, ethylene group,

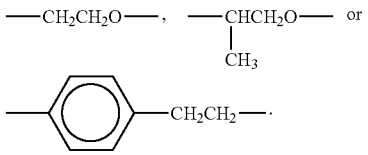

Preferably, Rb and Rc represent methyl group or ethyl group.

The radical-polymerizable compound (A) having a charge transport structure represented by the formulae (3), (4), or (5) opens their carbon-carbon double bonds on either side when being polymerized. Thus, the radical-polymerizable compound (A) having a charge transport structure is never located on a terminal of the resulting polymer. When being polymerized with radical-polymerizable compounds having no charge transport structure, the radical-polymerizable compound (A) having a charge transport structure is present in either the main chains or cross-linking chains. (The cross-linking chains include both an intermolecular chain that binds a polymer chain with another, and an intramolecular chain that binds a specific portion with another distant portion within a main chain of a folded polymer.) In either main chain or cross-linking chain, the triarylamine structure hangs from the chain while radially disposing three aryl groups from the nitrogen atom. Although being bulky, the triarylamine structure is sterically flexible because it indirectly hangs from the chain via a carbonyl group, etc. Thus, triarylamine structures are spatially disposed while forming a proper distance from each other without causing intramolecular structural strain. In the hardened protective layer 33, properly disposed triarylamine structures are not likely to break down electron transport paths.
Specific examples of the radical-polymerizable compound (A) having a charge transport structure are shown below, but are not limited thereto.
No. 1
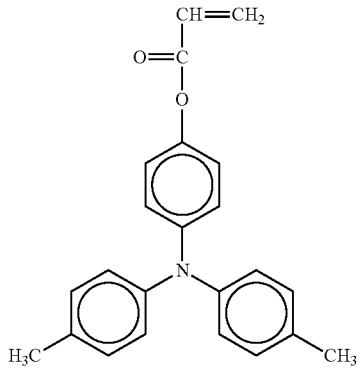
No. 2
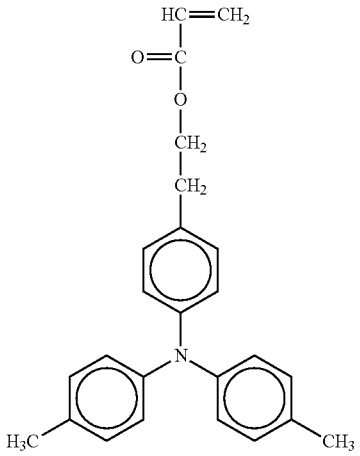
No. 3
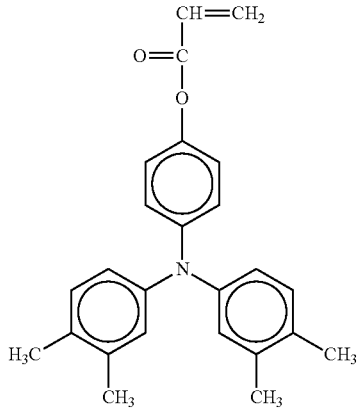
No. 4
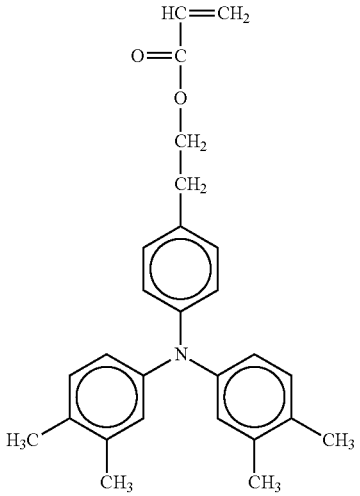
No. 5
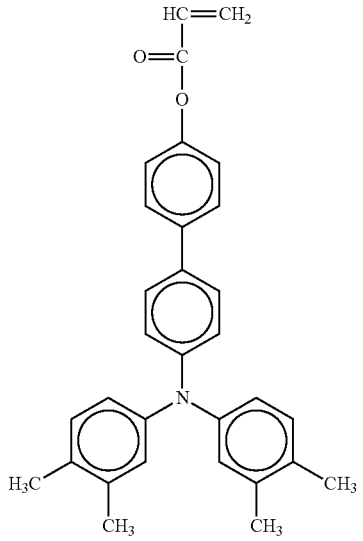
No. 6
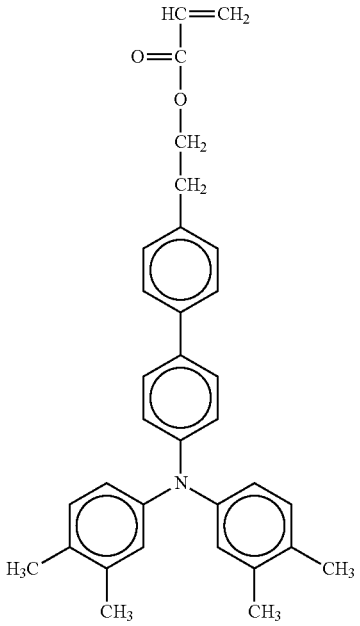

-continued
No. 7
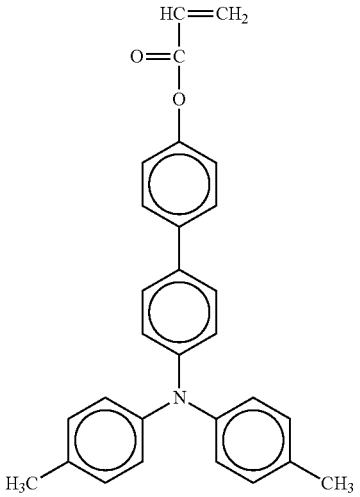
No. 8
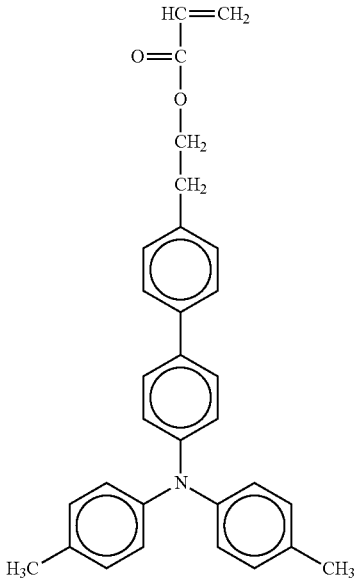
No. 9
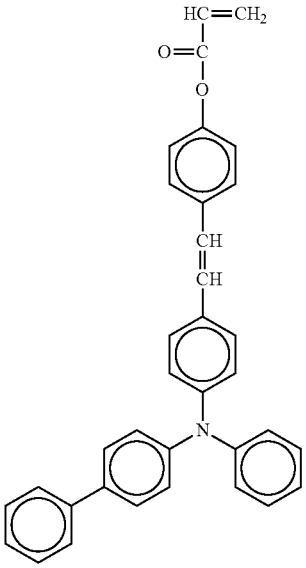
No. 10
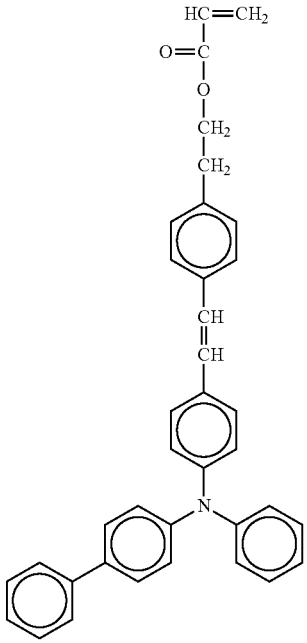

-continued
No. 11
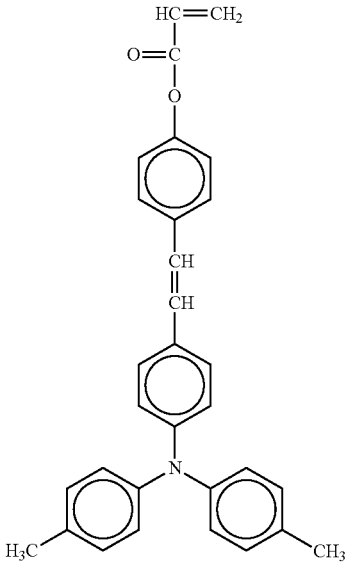
No. 12
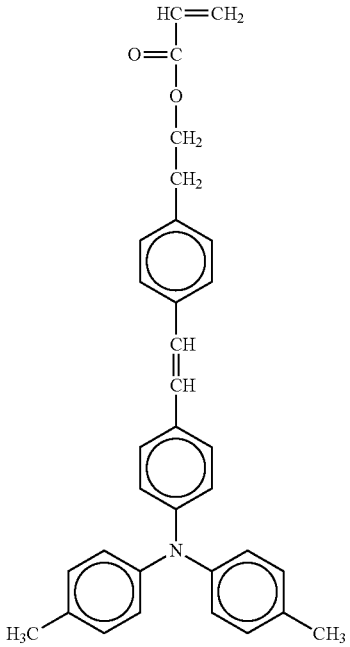
No. 13
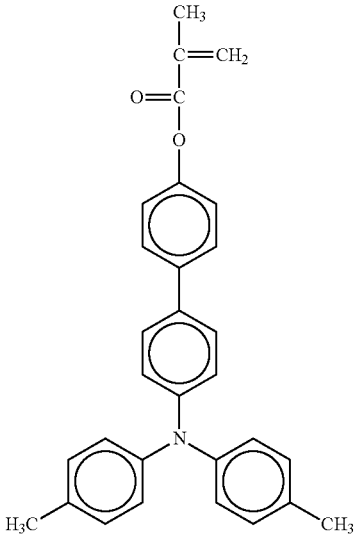
No. 14
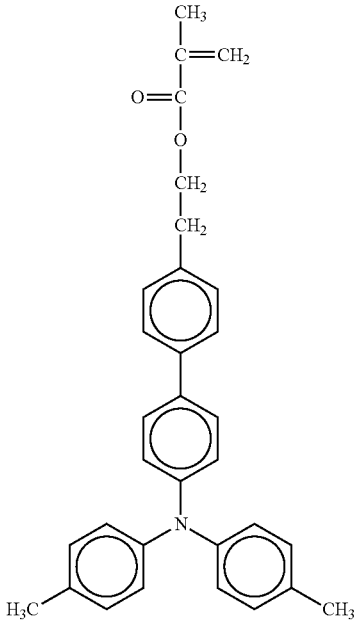

-continued
No. 15
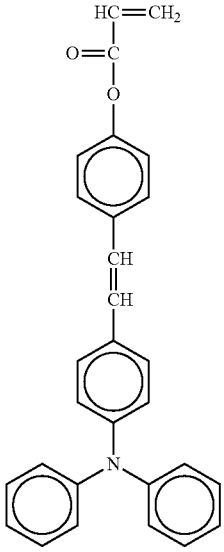
No. 16
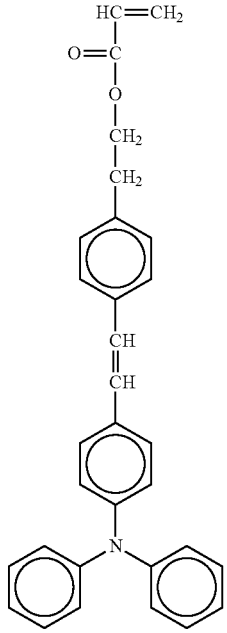
No. 17
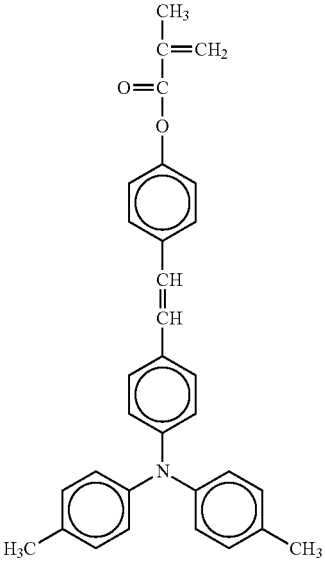
No. 18
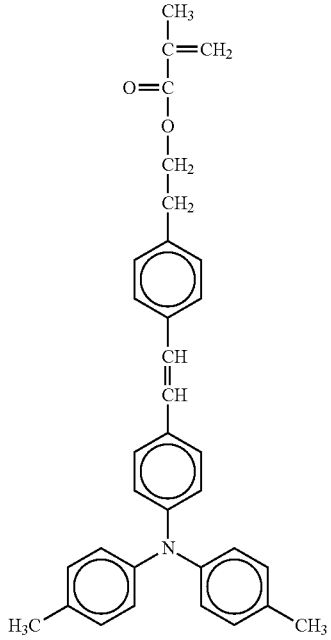

-continued
No. 19
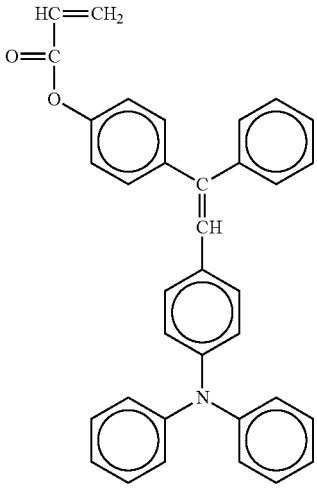
No. 20
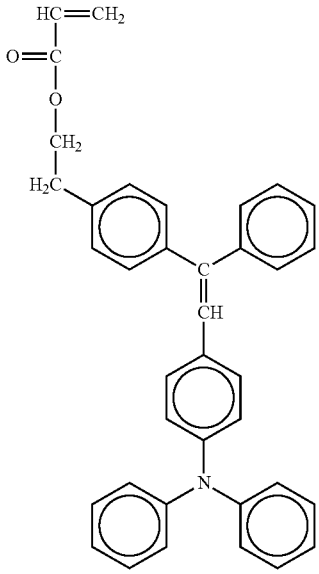
No. 21
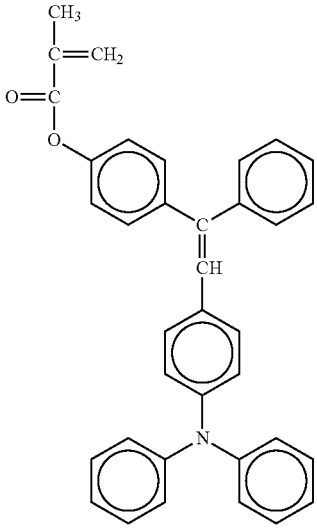
No. 22
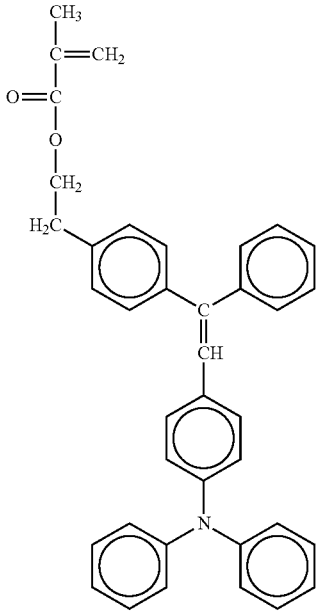

-continued
No. 23
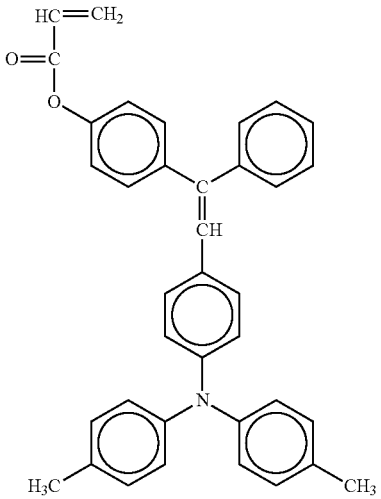
No. 24
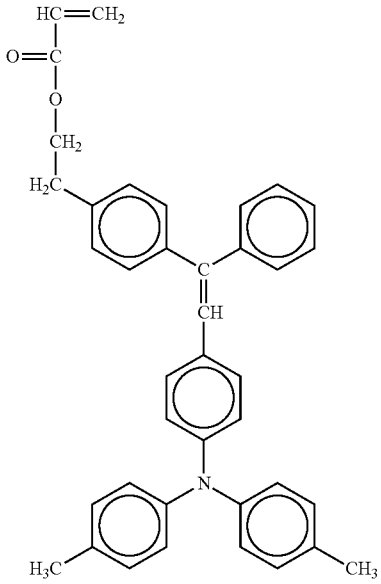
No. 25
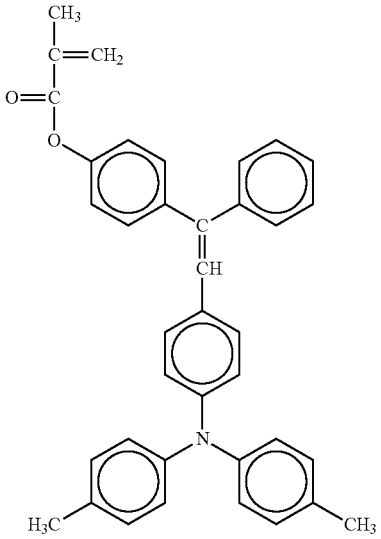
No. 26
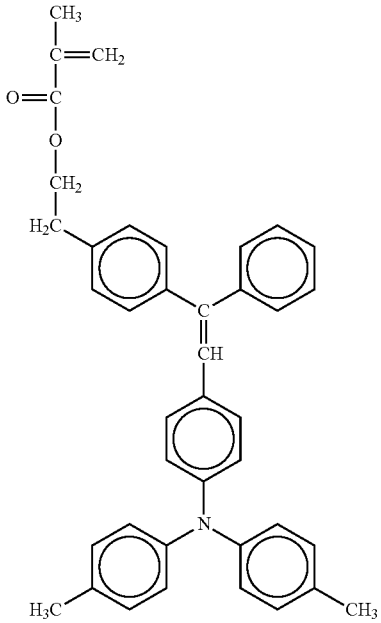
No. 27
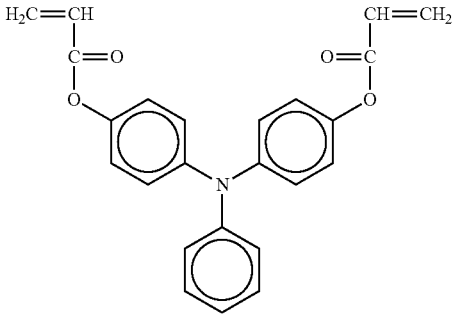
No. 28
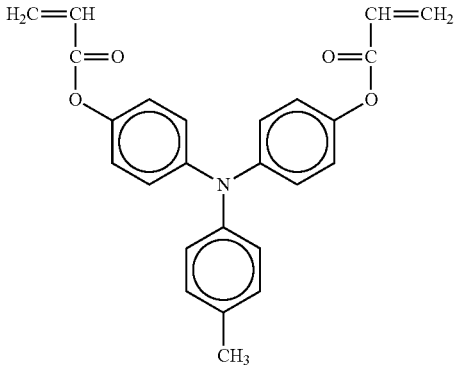

-continued
No. 29
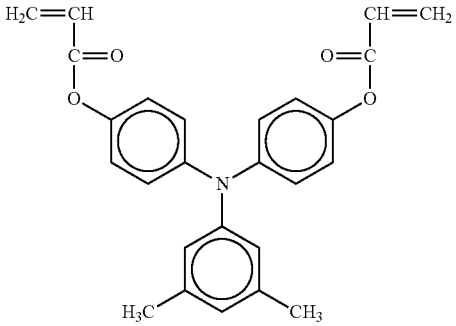
No. 30
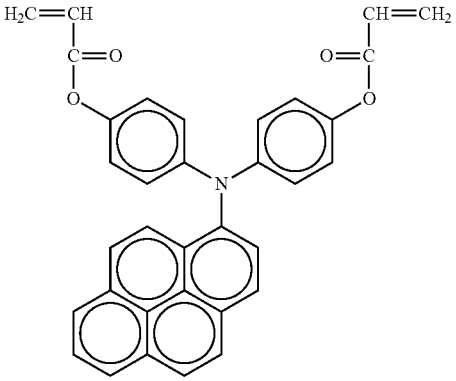
No. 31
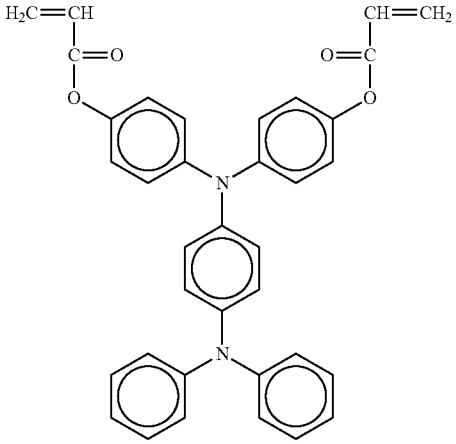
No. 32
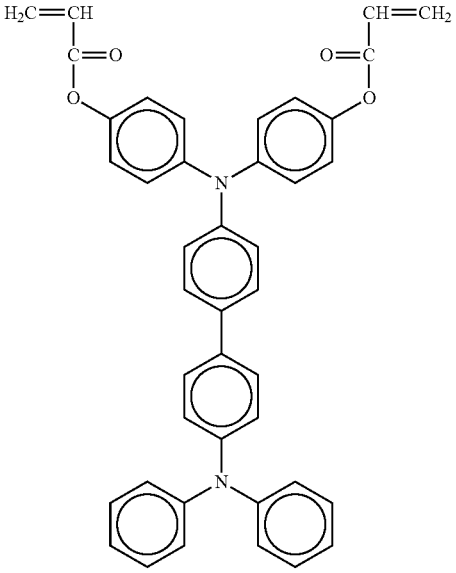
No. 33
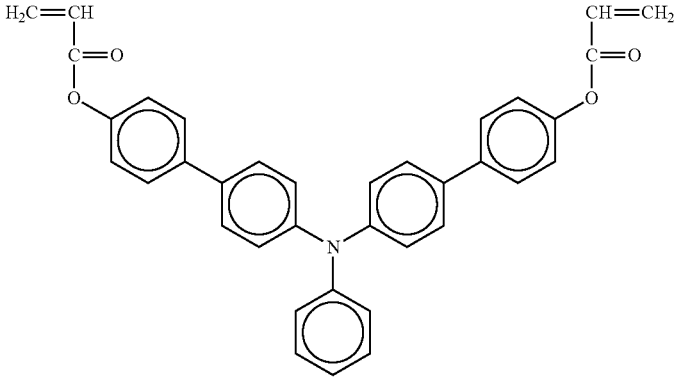

-continued
No. 34
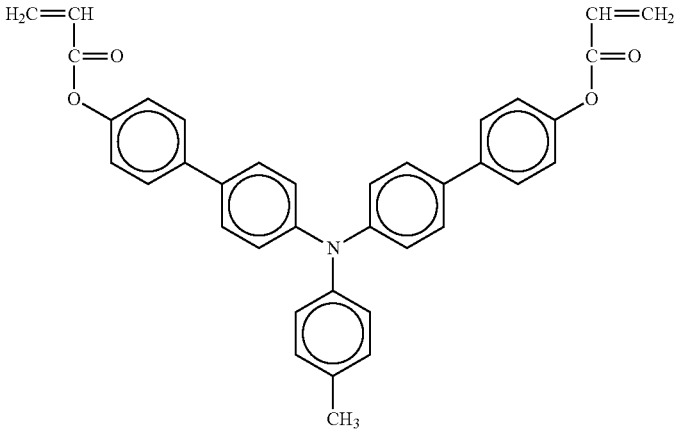
No. 35
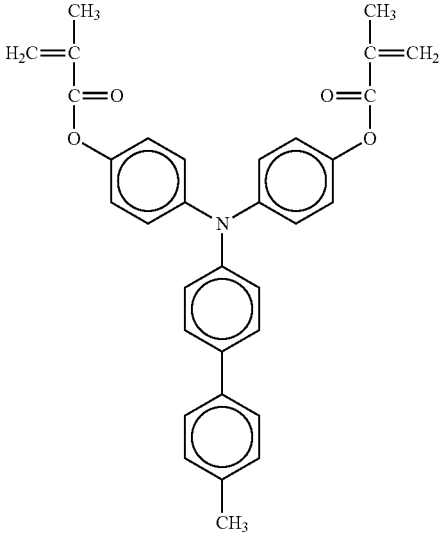
No. 36
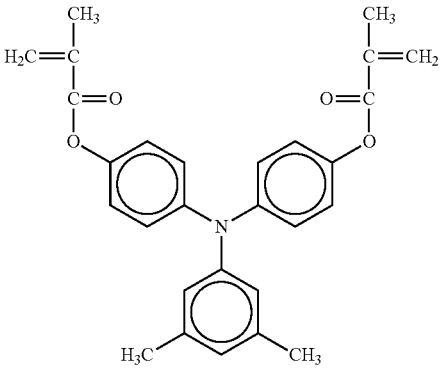
No. 37
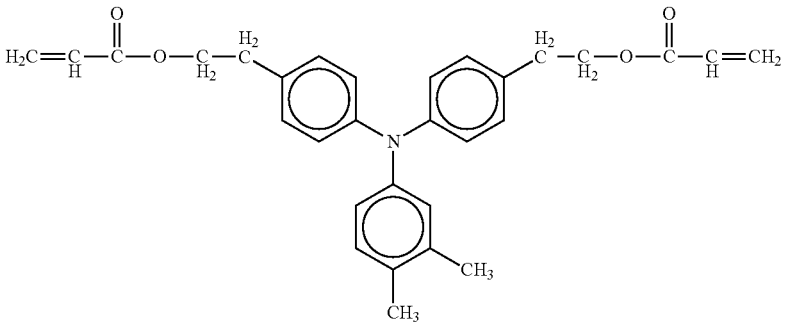
No. 38
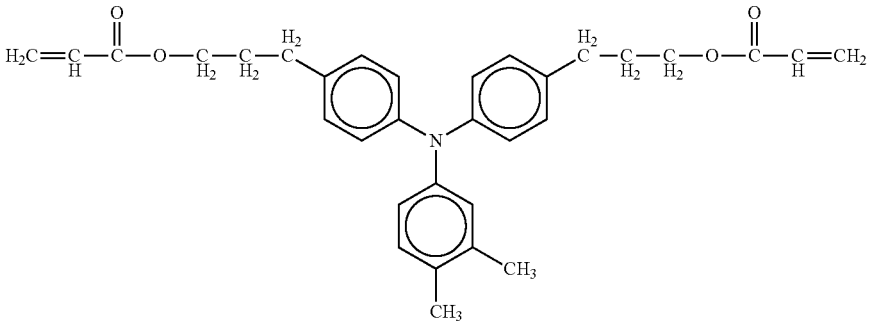

-continued

No. 39

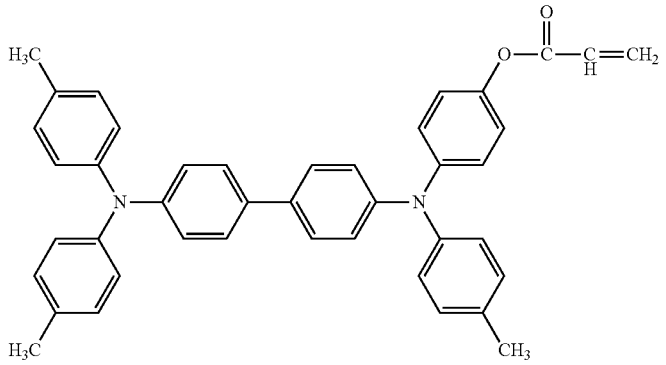

The content of the radical-polymerizable compound (A) having a charge transport structure in the hardened protective layer 33 is preferably 20 to 80% by weight, and more preferably 30 to 70% by weight. When the content is too small, charge transportability of the hardened protective layer 33 may be poor, thereby causing deterioration of sensitivity and increase of residual potential in repeated use. When the content is too large, cross-linking density of the hardened protective layer 33 may be too low to have proper abrasion resistance. Electric properties and abrasion resistance are generally balanced when the content is 30 to 70% by weight.

As above, the hardened protective layer 33 comprises a hardened material of a hardenable composition comprising the radical-polymerizable compound (A) having a charge transport structure and the radical-polymerizable compound (B) having an adamantane skeleton. More preferably, the hardened protective layer 33 comprises a hardened material of a hardenable composition comprising the radical-polymerizable compound (A) having a charge transport structure, the radical-polymerizable compound (B) having an adamantane skeleton, and the tri- or more functional radical-polymerizable compound (C).

To improve abrasion resistance, the hardened protective layer 33 may further include filler particles. The hardened protective layer 33 including filler particles is more resistant to nonuniform abrasion. Because the filler particles are reliably trapped and kept in the hardened or cross-linked resin matrix without desorption, abrasion resistance of the layer is considerably improved. In a case in which the filler particles are conductive, the hardened protective layer 33 is further given charge transportability.

Specific preferred examples of suitable filler particles include, but are not limited to, organic materials such as fluororesin powders (e.g., polytetrafluoroethylene), silicone resin powders, and carbon fine particles. Carbon fine particles have a structure consist primarily of carbon atoms, such as diamond, graphite, amorphous carbon, fullerene, Zeppelin, carbon nanotube, and carbon nanohorn. Among these, hydrogen-containing diamond and amorphous carbon have good combination of mechanical and chemical durability. In the hydrogen-containing diamond and amorphous carbon, a diamond structure having SP3 orbital, a graphite structure having SP2 orbital, and an amorphous carbon structure are coexisting. The hydrogen-containing diamond and amorphous carbon may include elements other than carbon, such as hydrogen, oxygen, nitrogen, fluorine, boron, phosphor, chloride, bromine, and iodine.

Specific preferred examples of suitable filler particles further include, but are not limited to, inorganic materials such as metal powders (e.g., copper, tin, aluminum, indium), metal oxides (e.g., silicone oxide, tin oxide, zinc oxide, titanium oxide, indium oxide, antimony oxide, bismuth oxide), and potassium titanate. Inorganic materials are advantageous in terms of hardness. Among the above materials, metal oxides are preferable. Particularly, silicone oxide, aluminum oxide, and titanium oxide are more preferable. Additionally, colloidal silica and colloidal alumina are also preferably used as the filler particles.

The filler particles preferably have an average primary particle diameter of 0.01 to 0.9 μm, more preferably 0.1 to 0.5 μm, from the viewpoint of light optical transparency and abrasion resistance of the hardened protective layer 33. When the average primary particle diameter is too small, both dispersibility of the filler particles and abrasion resistance of the resulting layer may be poor. When the average primary particle diameter is too large, sedimentation of the filler particles in a dispersion liquid may be accelerated.

The hardened protective layer 33 improves its abrasion resistance as the filler concentration increases. However, when the filler concentration is too large, increase of residual potential and/or deterioration of optical transparency may be undesirably caused. Thus, the hardened protective layer 33 preferably includes the filler in an amount of 50% by weight or less, more preferably 30% by weight or less. To more improve dispersibility, the filler may be surface-treated with a surface treatment agent. When the filler is poorly dispersed in the layer, increase of residual potential, deterioration of optical transparency and abrasion resistance, and/or coating defect may be undesirably caused.

The hardened protective layer 33 is formed upon application of at least one of heat, light, and ionizing radiation. When the hardened protective layer 33 is formed using heat or light, a polymerization initiator may be included as a raw material of the hardened protective layer 33 to accelerate cross-linking reaction. When the hardened protective layer 33 is formed using ionizing radiation, a polymerization initiator is not necessary, but is preferably included as a raw material of the hardened protective layer 33 to accelerate hardening of unreacted compounds upon application of heat and/or light, after application of ionizing radiation.

Specific examples of suitable thermal polymerization initiators include, but are not limited to, peroxide initiators such as 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3-di-t-butyl peroxide, t-butyl hydroperoxide, cumene hydroperoxide, and lauroyl peroxide; and azo initiators such as azobis isobutyronitrile, azobis cyclohexane carbonitrile, azobis methyl isobutyrate, azobis isobutylamidine hydrochloride, and 4,4'-azobis-4-cyano valeric acid.

Specific examples of suitable photopolymerization initiators include, but are not limited to, acetophenone and ketal initiators such as diethoxy acetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoine ether initiators such as benzoine, benzoine methyl ether, benzoine ethyl ether, benzoine isobutyl ether, and benzoine isopropyl ether; benzophenone initiators such as benzophenone, 4-hydroxy benzophenone, methyl o-benzoyl benzoate, 2-benzoyl naphthalene, 4-benzoyl biphenyl, 4-benzoyl phenyl ether, acrylic benzophenone, and 1,4-benzoyl benzene; thioxanthone initiators such as 2-isopropyl thioxanthone, 2-chloro thioxanthone, 2,4-dimethyl thioxanthone, 2,4-diethyl thioxanthone, and 2,4-dichloro thioxanthone; titanocene initiators such as bis(cyclopentadienyl)-di-chloro-titanium, bis(cyclopentadienyl)-di-phenyl-titanium, bis(cyclopentadienyl)-bis(2,3,4,5,6-pentafluorophenyl)titanium, and bis(cyclopentadienyl)-bis(2,6-difluoro-3-(pyrrol-1-yl)phenyl)titanium; and other initiators such as ethyl anthraquinone, 2,4,6-trimethylbenzoyl diphenylphosphine oxide, 2,4,6-trimethylbenzoyl phenyl ethoxy phosphine oxide, bis(2,4,6-trimethylbenzoyl)phenylphosphine oxide, bis(2,4-dimethoxybenzoyl)-2,4,4-trimethylpentylphosphine oxide, methylphenyl glyoxylate, 9,10-phenanthrene, acridine compounds, triazine compounds, and imidazole compounds.

Additionally, compounds that accelerate photopolymerization can be used alone or in combination with the above-described photopolymerization initiators. Specific examples of such compounds include, but are not limited to, triethanolamine, methyl diethanolamine, ethyl 4-dimethylaminobenzoate, isoamyl 4-dimethylaminobenzoate, (2-dimethylamino)ethyl benzoate, and 4,4'-dimethylamino benzophenone. Two or more of the above polymerization initiators can be used in combination. The useful amount of the polymerization initiator is 0.5 to 40 parts by weight, preferably 1 to 20 parts by weight, based on 100 parts by weight of the radical-polymerizable compounds.

The hardened protective layer 33 may include additives such as a plasticizer (for the purpose of stress relaxation and improvement of adhesiveness), a leveling agent, and a non-radical-polymerizable low-molecular-weight charge transport material, if needed. Specific examples of usable plasticizers include, but are not limited to, dibutyl phthalate and dioctyl phthalate, which are typically used for resins. The amount of the plasticizer is preferably 20 parts or less by weight, and more preferably 10 parts or less by weight, based on 100 parts by weight of solid components in the coating liquid. Specific examples of usable leveling agents include, but are not limited to, silicone oils such as dimethyl silicone oil and methylphenyl silicone oil, and polymers and oligomers having a perfluoroalkyl chain on a side chain thereof. The amount of the leveling agent is preferably 3 parts or less by weight based on 100 parts by weight of solid components in the coating liquid.

The hardened protective layer 33 can be formed by coating the photosensitive layer 32 with a coating liquid including a hardenable composition comprising the radical-polymerizable compound (A) having a charge transport structure, the radical-polymerizable compound (B) having an adamantane skeleton, and the tri- or more functional radical-polymerizable compound (C), followed by hardening of the hardenable composition.

In a case in which the radical-polymerizable compounds are liquid, the coating liquid can be prepared by dissolving the other components therein. If this is not the case, the coating liquid can be prepared by dissolving components in a solvent. Specific examples of usable solvents include, but are not limited to, alcohols such as methanol, ethanol, propanol, and butanol; ketones such as acetone, methyl ethyl ketone, methyl isobutyl ketone, and cyclohexanone; esters such as ethyl acetate and butyl acetate; ethers such as tetrahydrofuran, dioxane, and propyl ether; halogen solvents such as dichloromethane, dichloroethane, trichloroethane, and chlorobenzene; aromatic solvents such as benzene, toluene, and xylene; and cellosolves such as methyl cellosolve, ethyl cellosolve, and cellosolve acetate. Two or more of the above solvents can be used alone or in combination.

A suitable coating method for forming the hardened protective layer 33 is selected considering the viscosity of the coating liquid and a desired thickness of the resultant layer. For example, a dip coating method, a spray coating method, a bead coating method, and a ring coating method are preferable.

The coating liquid is then subjected to hardening upon application of external energy such as heat energy, light energy, and ionizing radiation. There is a possibility that ionizing radiation degrades materials composing a photoreceptor due to its deep energy immersion and energy strength, and causes deterioration of the resulting electrophotographic properties. Accordingly, heat energy and light energy are more preferable. Light energy is more preferable because the amount of solvent can be reduced and the strength of the resulting cross-linked layer can be increased. Alternatively, two or more of the above energies can be applied in combination.

Specific examples of the heat energies include, but are not limited to, air, gases such as nitrogen gas, vapors, heat media, infrared rays, and electromagnetic waves. The layer may be heated from either a coated side or a substrate side. The heating temperature is preferably 100 to 170° C. When the heating temperature is too low, the reaction speed may be too low, resulting in poor productivity. Moreover, unreacted materials may remain in the resultant layer. When the heating temperature is too high, the resultant layer may considerably contracts during cross-linking, resulting in formation of an orange-peel-like uneven surface and cracks. Further, the resultant layer may peel off from an adjacent layer. When volatile components in the photosensitive layer undesirably dissipate in the air, electrophotographic properties of the photosensitive layer may deteriorate. In a case in which the layer is considerably contracts during cross-linking, such a layer may be preliminarily cross-linked at a low temperature of less than 100° C. and subsequently cross-linked at a high temperature of 100° C. or more to complete cross-linking.

Suitable light energies are emitted from light sources such as ultrahigh pressure mercury lamps, high pressure mercury lamps, low pressure mercury lamps, carbon-arc lamps, and xenon-arc metal halide lamps. Preferably, a suitable light source is selected considering absorption properties of the radical-polymerizable compounds and a photopolymerization initiator in use. The light source preferably emits a light having a wavelength of 365 nm at an illumination intensity of 5 to 2000 mW/cm$^2$. More preferably, the light source emits a light having a maximum wavelength at the above-described illumination intensity. When the illumination intensity is too small, it takes a long time to complete hardening, thereby decreasing productivity. When the illumination intensity is too large, the resultant layer may considerably contracts by hardening, resulting in formation of an orange-peel-like uneven surface and cracks. Further, the resultant layer may peel off from an adjacent layer.

Ionizing radiation is a radiation that has an ionization effect on a substance. Specific examples of the ionizing radiations include, but are not limited to, direct ionizing radiations such as alpha rays and electron beams and indirect ionizing radiations such as X-rays and neutron rays. Considering effects of radioactivity on the human body, electron beams are preferable. Specific examples of usable electron beam irradiators include, but are not limited to, Cockcroft-Walton accelerator, van de Graaff accelerator, resonance transformer accelerator, insulated core transformer accelerator, linear accelerator, Dynamitron accelerator, and high-frequency accelerator. A suitable irradiance level may be determined depending on the thickness of the hardened protective layer 33. Preferably, the layer is irradiated with an electron having an energy amount of 100 to 1,000 keV, preferably 100 to 3,000 keV, at 0.1 to 30 Mrad. When the irradiance level is too small, the electron beam may not reach inside of the hardened protective layer 33, resulting in insufficient hardening in deep portions of the layer. When the irradiance level is too large, the electron beam may reach the charge transport layer or the charge generation layer, possibly adversely affecting materials therein.

When irradiated with UV or ionizing radiation, the temperature of the hardened protective layer 33 generally increases. If the temperature excessively increases, problems may arise such that the hardened protective layer 33 considerably contracts by hardening, and low-molecular-weight components in adjacent layers migrate to the hardened protective layer 33 and inhibit the hardening. As a result, electric properties of the photoreceptor deteriorate. Accordingly, the temperature of the hardened protective layer 33 is preferably 100° C. or less, and more preferably 80° C. or less, when irradiated with UV. One possible method of cooling the layer involves enclosing an auxiliary cooling agent inside the photoreceptor. Another possible method involves cooling gases and liquids inside the photoreceptor.

After completion of hardening, the hardened protective layer 33 may be further heated, as needed. For example, in a case in which a large amount of solvents remain in the layer, it is preferable the remaining solvents are volatilized by heating, so as to prevent deterioration of electric properties and time degradation of the photoreceptor.

The hardened protective layer 33 preferably has a thickness of 0.5 to 15 μm, and more preferably 2 to 10 μm, from the viewpoint of protection of the photosensitive layer 32. When the thickness of the hardened protective layer 33 is too small, the photosensitive layer cannot be protected from mechanical abrasion caused by a contact member and adjacent electric discharge caused by a charger. Further, the layer may have an orange-peel-like uneven surface. When the thickness of the hardened protective layer 33 is too large, the total thickness of the photoreceptor may be too large, causing charge diffusion. As a consequence, image reproducibility may deteriorate. When the hardened protective layer 33 is thicker than the photosensitive layer 32, bright section potential may undesirably increase. Accordingly, the following equation is preferably satisfied:

$$T1>T2\times 2$$

wherein T1 and T2 represent thicknesses of the photosensitive layer 32 and the hardened protective layer 33, respectively.

An adhesion layer may be provided between the hardened protective layer 33 and the photosensitive layer 32 for the purpose of preventing interlayer peeling. The adhesion layer may be formed using the above-described radical-polymerizable compounds or non-crosslinkable polymer compounds. Specific examples of usable non-crosslinkable polymer compounds include, but are not limited to, polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. Two or more of the above radical-polymerizable compounds can be used in combination. Two or more of the above non-crosslinkable polymer compounds can be used in combination. Of course, the radical-polymerizable compounds and the non-crosslinkable polymer compounds can be used in combination. In addition, any charge transport materials described in this specification can be also added to the adhesion layer. Further, additives for improving adhesiveness can be also added to the adhesion layer.

The adhesion layer can be formed by applying a coating liquid in which specific components are dissolved or dispersed in a solvent such as tetrahydrofuran, dioxane, dichloroethane, and cyclohexane, by a typical coating method such as a dip coating method, a spray coating method, a bead coating method, and a ring coating method. The adhesion layer preferably has a thickness of 0.1 to 5 μm, and more preferably 0.1 to 3 μm.

An undercoat layer may be provided between the conductive substrate 31 and the photosensitive layer 32. The undercoat layer includes a resin as a main component. Since the photosensitive layer 32 is formed on the undercoat layer using a solvent, the resin is required to have high resistance to the solvent. Specific examples of such resins include, but are not limited to, water-soluble resins such as polyvinyl alcohol, casein, and sodium polyacrylate; alcohol-soluble resins such as copolymerized nylon and methoxymethylated nylon; and hardening resins that form a three-dimensional network structure such as polyurethane, melamine resins, phenol resins, alkyd-melamine resins, and epoxy resins. Further, the undercoat layer may include fine powders of metal oxides such as titanium oxide, silica, alumina, zirconium oxide, tin oxide, and indium oxide, to prevent the occurrence of moiré and to decrease residual potential.

The undercoat layer can be formed by a typical coating method using a proper solvent, in the same way as the formation of the photosensitive layer. Silane coupling agents, titan coupling agents, and chrome coupling agents are also usable for the undercoat layer. Further, $Al_2O_3$ formed by anodic oxidization, and thin films of organic materials such as polyparaxylene (parylene) and inorganic materials such as $SiO_2$, $SnO_2$, $TiO_2$, ITO and $CeO_2$ formed by a vacuum method, are also usable as the undercoat layer. The undercoat layer preferably has a thickness of 0 to 5 μm.

A blocking layer may be provided between the conductive substrate 31 and the undercoat layer, or between the undercoat layer and the photosensitive layer 32. The blocking layer prevents hole injection from the conductive substrate 31 to prevent background fouling in the resulting image. The blocking layer generally includes a binder resin as a main component. Specific examples of usable binder resins include, but are not limited to, polyamide, alcohol-soluble polyamide, alcohol-soluble nylon, water-soluble polyvinyl butyral, polyvinyl butyral, and polyvinyl alcohol. The blocking layer can be formed by the typical coating method described above. The blocking layer typically has a thickness of 0.05 to 2 μm. A combination of the blocking layer and the undercoat layer drastically prevents background fouling, however, is likely to increase residual potential. Accordingly, the composition and thickness of the blocking and undercoat layers should be optimized.

In order to improve environmental resistance, in particular, to reliably obtain high quality images, an antioxidant may be included in each layer, i.e., the hardened protective layer 33, the photosensitive layer 32, the undercoat layer, etc.

Specific preferred examples of suitable antioxidants include, but are not limited to, phenol compounds, p-phenylenediamines, hydroquinones, organic sulfur compounds, and organic phosphor compounds.

Specific examples of usable phenol compounds include, but are not limited to, 2,6-di-t-butyl-p-cresol, butylated hydroxyanisole, 2,6-di-t-butyl-4-ethylphenol, stearyl-β-(3,5-di-t-butyl-4-hydroxyphenyl) propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, and tocopherols.

Specific examples of usable p-phenylenediamines include, but are not limited to, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Specific examples of usable hydroquinones include, but are not limited to, 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Specific examples of usable organic sulfur compounds include, but are not limited to, dilauryl-3,3'-thiodipropionate, distearyl-3,3'-thiodipropionate, and ditetradecyl-3,3'-thiodipropionate.

Specific examples of usable organic phosphor compounds include, but are not limited to, triphenylphosphine, tri(nonylphenyl)phosphine, tri(dinonylphenyl)phosphine, tricresylphosphine, and tri(2,4-dibutylphenoxy)phosphine.

The above-described compounds are well known as antioxidants for use in rubbers, plastics, oils, and fats, and are commercially available.

The content of the antioxidant in a layer is preferably 0.01 to 10 parts by weight based on total weight of the layer.

Figure 2:
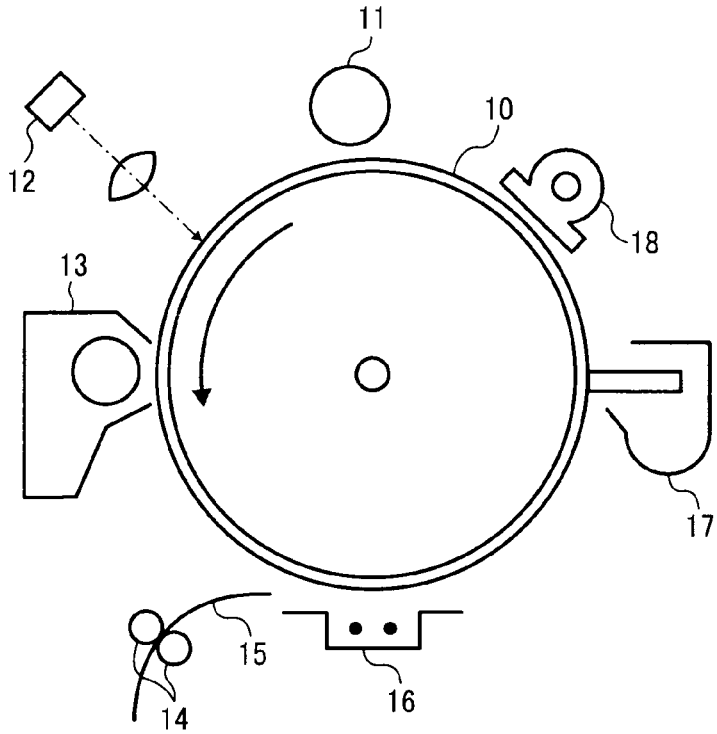
FIG. 2 schematically illustrates an image forming apparatus according to exemplary aspects of the invention.

FIG. 2 schematically illustrates an image forming apparatus according to exemplary aspects of the invention. A photoreceptor 10 rotates counterclockwise in FIG. 2. Around the photoreceptor 10, a charging member 11, an irradiating member 12, a developing member 13, a transfer member 16, a cleaning member 17, and a neutralization member 18 are disposed. The cleaning member 17 and neutralization member 18 are not necessarily disposed.

In an image forming operation, first, the charging member 11 uniformly charges a surface of the photoreceptor 10. The irradiating member 12 then emits light to the charged surface of the photoreceptor 10 based on image information corresponding to input signal to form an electrostatic latent image thereon. The developing member 13 develops the electrostatic latent image into a toner image. The transfer member 16 transfers the toner image onto a transfer paper 15 that is fed to a transfer area by a feed roller 14. The toner image is then fixed on the transfer paper 15 by a fixing device, not shown. Residual toner particles remaining on the photoreceptor 10 without being transferred onto the transfer paper 15 are removed by the cleaning member 17. Residual charges remaining on the photoreceptor 10 are removed by the neutralization member 18 to be ready for a next image forming operation.

A photoreceptor 10 illustrated in FIG. 2 has a drum-like shape. Alternatively, the photoreceptor 10 may have a sheet-like shape or an endless-belt-like shape. Each of the charging member 11 and the transfer member 16 may be a charger such as a corotron, a scorotron, a solid state charger, a charging roller, a charging brush, for example.

Suitable light sources for the irradiating member 12 and the neutralization member 18 include illuminants such as a fluorescent lamp, a tungsten lamp, a halogen lamp, a mercury lamp, a sodium lamp, a light-emitting diode (LED), a laser diode (LD), and an electroluminescence (EL). Among these illuminants, a laser diode (LD) and a light-emitting diode (LED) are preferable.

In order to obtain light having a desired wavelength range, filters such as a sharp-cut filter, a band pass filter, a near-infrared cutting filter, a dichroic filter, an interference filter, and a color temperature converting filter, can be used.

In a case in which the transfer process, neutralization process, and/or cleaning process require light irradiation, or a pre-irradiation process is further provided, the photoreceptor 10 may be irradiated with light in such processes. In particular, in a case in which the photoreceptor 10 is irradiated with light in the neutralization process, in other words, the photoreceptor 10 is neutralized by light irradiation, the photoreceptor 10 is considerably fatigued and undesirably causes charge deterioration and residual potential increase.

Therefore, the photoreceptor 10 may be alternatively neutralized by application of the reverse bias in the charging or cleaning process, which is preferable in terms of durability of the photoreceptor.

Generally, when the photoreceptor 10 is positively (negatively) charged and irradiated with light, a positive (negative) electrostatic latent image is formed thereon. When the positive (negative) electrostatic latent image is developed with a negatively (positively) chargeable toner, a positive image is produced. By contrast, when the positive (negative) electrostatic latent image is developed with a positively (negatively) chargeable toner, a negative image is produced.

After repeated image forming operations, contaminants may be adhered to the surface of the photoreceptor 10. For example, electric discharge byproducts and external additives of toner are representative contaminants. They undesirably cause image defect depending on humidity. Also, paper powder is also a representative contaminant, which undesirably causes image defect, nonuniform abrasion, and deterioration of abrasion resistance. In particular, such contamination is a large problem for image forming apparatuses employing a direct transfer method, which has an advantage in downsizing and cost reduction. Accordingly, mechanically-durable photoreceptors that are not adhesive to contaminants are demanded.

The toner image formed on the photoreceptor 10 by the developing member 13 is then transferred onto the transfer paper 15. Some toner particles may remain on the photoreceptor 10 without being transferred onto the transfer paper 15. Such residual toner particles are removed from the photoreceptor 10 by the cleaning member 17.

The cleaning member 17 may be, for example, a cleaning blade or a cleaning brush. They can be used in combination. If toner particles cannot be effectively transferred, a large amount of toner particles remains on the photoreceptor without being transferred. As a result, the cleaning member 17 deteriorates. Accordingly, toner particles which can be effectively transferred are demanded so as to reduce waste toner particles.

The above-described image forming members are mounted on a copier, a facsimile machine, or a printer. Alternatively, they can be mounted thereon in the form of a process cartridge.

Figure 3:
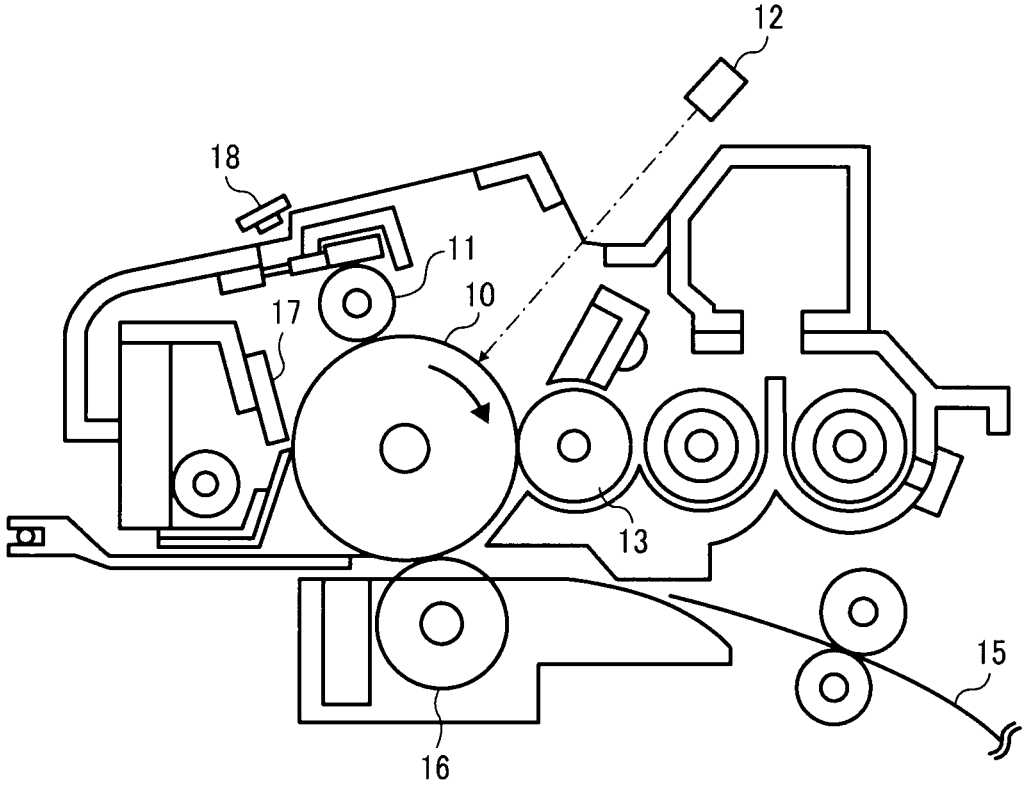
FIG. 3 schematically illustrates a process cartridge according to exemplary aspects of the invention.

FIG. 3 schematically illustrates a process cartridge according to exemplary aspects of the invention. The process cartridge is comprised of the photoreceptor 10, charging member 11, irradiating member 12, developing member 13, transfer member 16, cleaning member 17, and neutralization member 18.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

Preparation of Charge Generation Material

A titanyl phthalocyanine crystal was prepared with reference to the method disclosed in JP-2004-83859-A, the disclosure thereof being incorporated herein by reference. First, 292 parts of 1,3-diiminoisoindoline and 1,800 parts of sulfolane were mixed, and 204 parts of titanium tetrabutoxide were dropped therein under nitrogen gas flow. The resulting mixture was gradually heated to 180° C. and subjected to a reaction for 5 hours at 170 to 180° C. while being agitated. After termination of the reaction, the mixture was left to cool. The cooled mixture was filtered and the deposits were washed with chloroform until expressing blue color, then washed with methanol for several times, and further washed with hot water of 80° C. for several times, followed by drying. Thus, a crude titanyl phthalocyanine was prepared. The crude titanyl phthalocyanine was dissolved in concentrated sulfuric acid 20 times the amount thereof, and subsequently dropped in ice water 100 times the amount thereof while being agitated. The mixture was filtered, and the deposited crystal was washed with ion-exchange water having a pH of 7.0 and a specific conductance of 1.0 μS/cm until the used ion-exchange water became neutral, in other words, had a pH of 6.8 and a specific conductance of 2.6 μS/cm. Thus, a wet cake (i.e., water paste) of a titanyl phthalocyanine was prepared.

Figure 4:
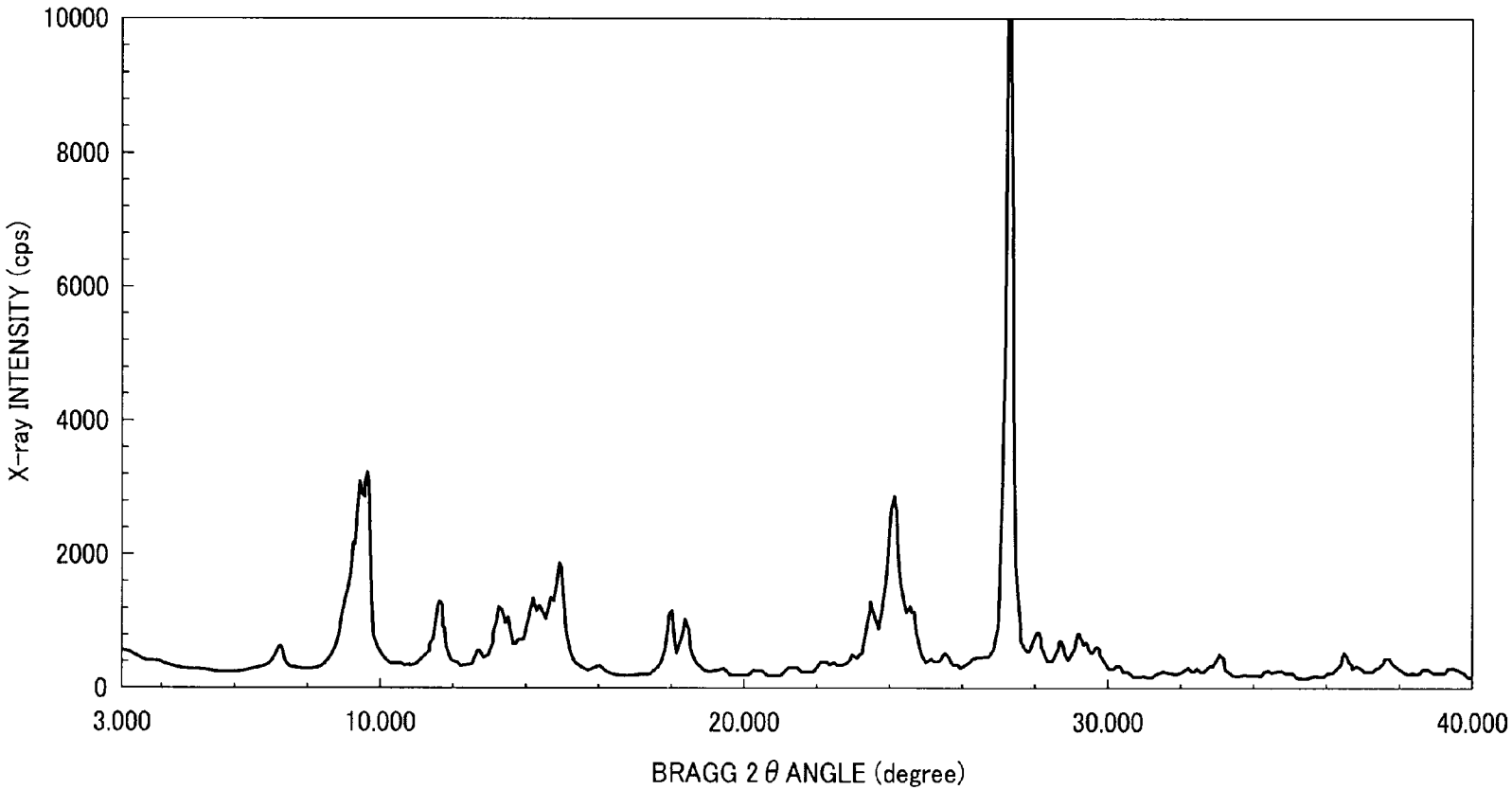
FIG. 4 is an X-ray diffraction spectrum of a titanyl phthalocyanine used for an electrophotographic photoreceptor according to exemplary aspects of the invention.

Next, 40 parts of the wet cake (i.e., water paste) were poured into 200 parts of tetrahydrofuran, and the resulting mixture was strongly agitated at room temperature at a revolution of 2,000 rpm using a HOMOMIXER (MARK II f model from Kenis Ltd.) until the color of the paste changed from navy blue to pale blue, resulting in 20-minutes agitation. Subsequently, the mixture was filtered under reduced pressure. The deposited crystal was washed with tetrahydrofuran, thus obtaining a wet cake of a pigment. The wet cake was then dried for 2 days at 70° C. under reduced pressure of 5 mmHg. Thus, 8.5 parts of a titanyl phthalocyanine crystal were prepared. The wet cake was including solid components in an amount of 15% by weight. The amount of the crystal conversion solvent was 33 times the amount of the wet cake. It is to be noted that no halogen-containing compound was used in Synthesis Example 1. FIG. 4 is an X-ray diffraction spectrum of the above-prepared titanyl phthalocyanine, obtained with a characteristic X-ray specific to CuKc having a wavelength of 1.542 Å. Referring to FIG. 4, the titanyl phthalocyanine has a maximum peak at 27.2±0.2°, a lowest-side-angle peak at 7.3±0.2°, main peaks at 9.4±0.2°, 9.6±0.2°, and 24.0±0.2°, and no peak within a range between 7.3° and 9.4° and at 26.3°, as diffraction peaks of Bragg angle 2θ.

The X-ray diffraction spectrum was obtained under the following conditions.

X-ray tube: Cu

Voltage: 50 kV

Current: 30 mA

Scanning velocity: 2°/min

Scanning range: 3° to 40°

Time constant: 2 seconds

Synthesis Example 2

Preparation of Monofunctional Radical-Polymerizable Compound (A) Having Charge Transport Structure A radical-polymerizable compound (A) having a charge transport structure was prepared with reference to the method disclosed in JP 3164426, the disclosures thereof being incorporated herein by reference, as follows.

(1) Synthesis of Hydroxyl-Group-Substituted Triarylamine Compound Having Formula (B)

First, 113.85 parts (0.3 mol) of a methoxy-group-substituted triarylamine compound having the following formula (A), 138 parts (0.92 mol) of sodium iodide, and 240 parts of sulfolane were mixed and heated to 60° C. under nitrogen gas flow. Next, 99 parts (0.91 mol) of trimethyl chlorosilane were dropped therein over a period of 1 hour. The resulting mixture was agitated for 4.5 hours at about 60° C. to terminate the reaction.

About 1,500 parts of toluene were added to the reaction mixture and cooled to room temperature. Subsequently, the reaction mixture was washed with water and a sodium carbonate aqueous solution repeatedly.

Finally, solvents were removed from the reaction mixture. The reaction mixture was then subjected to a column chromatography (adsorption medium: silica gel, solvent: toluene/ethyl acetate (20/1)) to be refined.

Cyclohexane was added to the resultant light-yellow oil so that crystals were deposited.

Thus, 88.1 parts of a white crystal having the following formula (B) was prepared. The yield was 80.4%. The crystal had a melting point of 64.0 to 66.0° C. The ultimate analysis results are shown in Table 1.

TABLE 1

| | C (%) | H (%) | N (%) |
|---|---|---|---|
| Measured Value | 85.06 | 6.41 | 3.73 |
| Calculated Value | 85.44 | 6.34 | 3.83 |

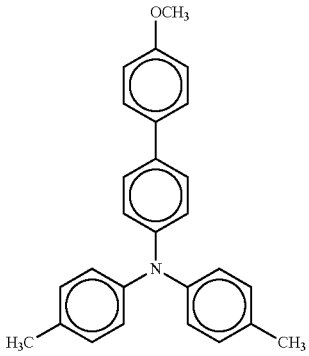

(A)

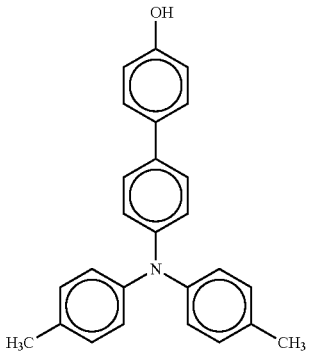

(B)

(2) Synthesis of Triarylamino-Group-Substituted Acrylate Compound (Compound No. 7)

First, 82.9 parts (0.227 mol) of the above-prepared hydroxyl-group-substituted triarylamine compound having the formula (B) were dissolved in 400 ml of tetrahydrofuran, and a sodium hydroxide aqueous solution (including 12.4 parts of NaOH and 100 ml of water) was dropped therein under nitrogen gas flow. The mixture was then cooled to 5° C., and 25.2 parts (0.272 mol) of chloride acrylate were dropped therein over a period of 40 minutes. The mixture was agitated for 3 hours at 5° C. to terminate the reaction. Water was poured therein, and the reaction mixture was extracted by toluene. The extracted liquid was repeatedly washed with a sodium hydrogen carbonate aqueous solution and water. Finally, solvents were removed from the reaction mixture. The reaction mixture was then subjected to a column chromatography (adsorption medium: silica gel, solvent: toluene) to be refined. n-Hexane was added to the resultant colorless oil so that crystals were deposited. Thus, 80.73 parts of a white crystal of the compound No. 7 was prepared. The yield was 84.8%.

The crystal had a melting point of 117.5 to 119.0° C. The ultimate analysis results are shown in Table 2.

TABLE 2

| | C (%) | H (%) | N (%) |
|---|---|---|---|
| Measured Value | 83.13 | 6.01 | 3.16 |
| Calculated Value | 83.02 | 6.00 | 3.33 |

Preparation of Electrophotographic Photoreceptor

An aluminum cylinder (i.e., a conductive substrate) having a diameter of 100 mm was coated with an undercoat layer coating liquid, followed by drying at 130° C. for 20 minutes. The resulting undercoat layer was coated with a charge generation layer coating liquid, followed by drying at 95° C. for 20 minutes. The resulting charge generation layer was coated with a charge transport layer coating liquid, followed by drying at 120° C. for 20 minutes. The resulting charge transport layer was coated with and a hardened protective layer coating liquid, followed by light exposure from a UV lamp with H bulb (from Fusion UV Systems Japan KK) at a power of 200 W/cm and an intensity of 450 mW/cm$^2$ for 30 seconds, and succeeding drying at 130° C. for 20 minutes. Thus, an electrophotographic photoreceptor comprised of the conductive substrate, the undercoat layer having a thickness of about 3.5 μm, the charge generation layer having a thickness of about 0.2 μm, the charge transport layer having a thickness of about 23 μm, and the hardened protective layer having a thickness of about 5 μm was prepared. The compositions of the coating liquids are described below.

Undercoat Layer Coating Liquid

The undercoat layer coating liquid was prepared by mixing 50 parts of a titanium oxide (CR-EL from Ishihara Sangyo Kaisha Ltd., having an average primary particle diameter of about 0.25 μm), 14 parts of an alkyd resin (BECKOLITE M6401-50 from DIC Corporation, containing 50% of solid components), 8 parts of a melamine resin (L-145-60 from DIC Corporation, containing 60% of solid components), and 70 parts of 2-butanone.

Charge Generation Layer Coating Liquid

The charge generation layer coating liquid was prepared by subjecting 15 parts of a titanyl phthalocyanine crystal, 10 parts of a polyvinyl butyral (BX-1 from Sekisui Chemical Co., Ltd.), and 280 parts of 2-butanone to a dispersion treatment using a commercially available bead mill disperser filled with PSZ balls having a diameter of 0.5 mm at a revolution of 1,200 rpm for 30 minutes.

Charge Transport Layer Coating Liquid

The charge transport layer coating liquid was prepared by mixing 10 parts of a bisphenol Z polycarbonate (PANLITE TS-2050 from Teijin Chemicals Ltd.), 7 parts of a charge transport material having the following formula, and 68 parts of tetrahydrofuran.

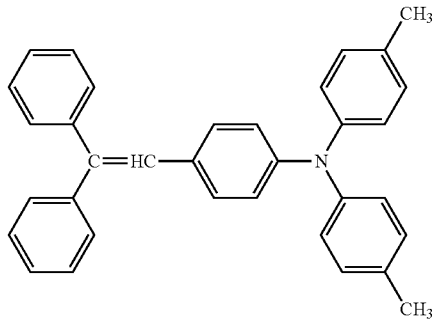

Hardened Protective Layer Coating Liquid

The hardened protective layer coating liquid was prepared by mixing 10 parts of a mixture of a radical-polymerizable compound having an adamantane skeleton and a radical-polymerizable compound having no adamantane skeleton; 10 parts of a radical-polymerizable compound having a charge transport structure or a charge transport material CTM-1; 1 part of a polymerization initiator, i.e., 1-hydroxy-cyclohexyl-phenyl-ketone (IRGACURE 184 from Ciba Specialty Chemicals Inc.); and 119 parts of a solvent, i.e., tetrahydrofuran.

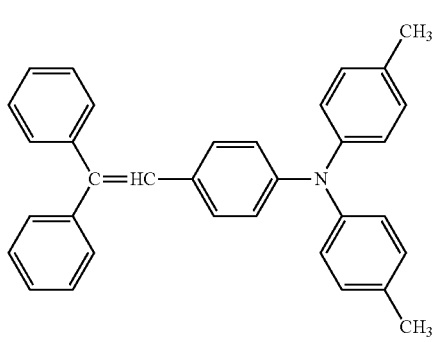

(CTM-1)

As the radical-polymerizable compound having an adamantane skeleton, the above-described compounds Adamantane-1 (ADAMANTATE X-A-101 available from Idemitsu Kosan Co., Ltd.), Adamantane-2 (ADAMANTATE A-201 available from Idemitsu Kosan Co., Ltd.), Adamantane-3 (available from Idemitsu Kosan Co., Ltd. or obtainable by a method described in JP-2000-119220-A, the disclosures thereof being incorporated herein by reference), Adamantane-4 (ADAMANTATE X-F-102 available from Idemitsu Kosan Co., Ltd.), Adamantane-5 (available from Idemitsu Kosan Co., Ltd. or obtainable by a method described in WO07/020,901, the disclosures thereof being incorporated herein by reference), and Adamantane-6 (ADAMANTATE X-F-204 available from Idemitsu Kosan Co., Ltd.) were used.

As non-radical-polymerizable compounds having an adamantane skeleton, the following compounds APC (having a viscosity average molecular weight of 50,000) and Adamantane-7 (ADAMANTANE A0696 available from Tokyo Chemical Industry Co., Ltd.) were used.

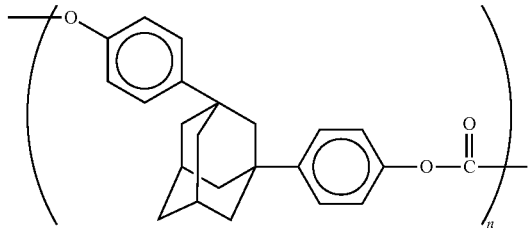

(APC)

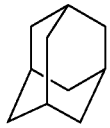

(Adamantane-7)

As the radical-polymerizable compounds having no adamantane skeleton, the following compounds AM-1 (trimethylolpropane triacrylate, KAYARAD TMPTA available from Nippon Kayaku Co., Ltd., wherein the molecular weight is 296, the number of functional groups is 3, and the ratio of the molecular weight to the number of functional groups is 99), AM-3 (dipentaerythritol caprolactone-modified hexaacrylate, KAYARAD DPCA-120 available from Nippon Kayaku Co., Ltd., wherein the molecular weight is 1,947, the number of functional groups is 6, and the ratio of the molecular weight to the number of functional groups is 325), AM-4 (isobornyl acrylate, IBXA available from Osaka Organic Chemical Industry Ltd.), AM-5 (cyclohexyl acrylate, VISCOAT #155 available from Osaka Organic Chemical Industry Ltd.), AM-6 (tetrahydrofurfuryl acrylate, VISCOAT #150 available from Osaka Organic Chemical Industry Ltd.), and AM-7 (benzyl acrylate, VISCOAT #160 available from Osaka Organic Chemical Industry Ltd.) were used.

The compositions of the hardened protective layer 33 of each photoreceptor are shown in Table 3.

TABLE 3

| | Compound Having Adamantane Skeleton | | Compound Having No Adamantane Skeleton | | | | | |
|---|---|---|---|---|---|---|---|---|
| | Name | Amount (part) | Name | Amount (part) | Molecular Weight/ Number of Functional Groups | Number of Functional Groups | Adamantane Ratio | Charge Transport Compound |
| Ex. 1 | Adamantane-1 | 5 | AM-1 | 5 | 99 | 3 | 0.5 | No. 7 |
| Ex. 2 | Adamantane-2 | 5 | AM-1 | 5 | 99 | 3 | 0.5 | No. 7 |
| Ex. 3 | Adamantane-3 | 5 | AM-1 | 5 | 99 | 3 | 0.5 | No. 7 |
| Ex. 4 | Adamantane-4 | 5 | AM-1 | 5 | 99 | 3 | 0.5 | No. 7 |
| Ex. 5 | Adamantane-5 | 5 | AM-1 | 5 | 99 | 3 | 0.5 | No. 7 |
| Ex. 6 | Adamantane-6 | 5 | AM-1 | 5 | 99 | 3 | 0.5 | No. 7 |
| Ex. 7 | Adamantane-2 | 10 | — | 0 | — | — | 1 | No. 38 |
| Ex. 8 | Adamantane-3 | 10 | — | 0 | — | — | 1 | No. 38 |
| Ex. 9 | Adamantane-5 | 10 | — | 0 | — | — | 1 | No. 38 |
| Ex. 10 | Adamantane-6 | 10 | — | 0 | — | — | 1 | No. 38 |
| Ex. 11 | Adamantane-1 | 5 | AM-1 | 5 | 99 | 3 | 0.5 | No. 39 |
| Ex. 12 | Adamantane-1 | 5 | AM-1 | 5 | 99 | 3 | 0.5 | No. 38 |
| Ex. 13 | Adamantane-1 | 9.5 | AM-3 | 0.5 | 324 | 6 | 0.95 | No. 7 |
| Ex. 14 | Adamantane-3 | 9.5 | AM-3 | 0.5 | 324 | 6 | 0.95 | No. 7 |
| Ex. 15 | Adamantane-1 | 9.5 | AM-1 | 0.5 | 99 | 3 | 0.95 | No. 7 |
| Ex. 16 | Adamantane-3 | 9.5 | AM-1 | 0.5 | 99 | 3 | 0.95 | No. 7 |
| Ex. 17 | Adamantane-5 | 9.5 | AM-1 | 0.5 | 99 | 3 | 0.95 | No. 7 |
| Ex. 18 | Adamantane-6 | 9.5 | AM-1 | 0.5 | 99 | 3 | 0.95 | No. 7 |
| Ex. 19 | Adamantane-1 | 1.9 | AM-1 | 8.1 | 99 | 3 | 0.19 | No. 7 |
| Ex. 20 | Adamantane-3 | 9.1 | AM-1 | 0.9 | 99 | 3 | 0.91 | No. 7 |

TABLE 3-continued

| | Compound Having Adamantane Skeleton | | Compound Having No Adamantane Skeleton | | | | | |
|---|---|---|---|---|---|---|---|---|
| | Name | Amount (part) | Name | Amount (part) | Molecular Weight/ Number of Functional Groups | Number of Functional Groups | Adamantane Ratio | Charge Transport Compound |
| Ex. 21 | Adamantane-1 | 2 | AM-1 | 8 | 99 | 3 | 0.2 | No. 7 |
| Ex. 22 | Adamantane-3 | 9 | AM-1 | 1 | 99 | 3 | 0.9 | No. 7 |
| Comp. Ex. 1 | — | 0 | AM-1 | 10 | 99 | 3 | 0 | No. 7 |
| Comp. Ex. 2 | Adamantane-2 | 5 | AM-1 | 5 | 99 | 3 | 0.5 | CTM-1 |
| Comp. Ex. 3 | — | — | AM-1 | 5 | 99 | 3 | 0 | No. 7 |
| | | | AM-4 | 5 | — | — | | |
| Comp. Ex. 4 | — | — | AM-1 | 5 | 99 | 3 | 0 | No. 7 |
| | | | AM-5 | 5 | — | — | | |
| Comp. Ex. 5 | — | — | AM-1 | 5 | 99 | 3 | 0 | No. 7 |
| | | | AM-6 | 5 | — | — | | |
| Comp. Ex. 6 | — | — | AM-1 | 5 | 99 | 3 | 0 | No. 7 |
| | | | AM-7 | 5 | — | — | | |
| Comp. Ex. 7 | APC | 10 | — | 0 | — | — | 1 | CTM-1 |
| Comp. Ex. 8 | Adamantane-7 | 5 | AM-1 | 5 | 99 | 3 | 0.5 | No. 7 |

Each of the above-prepared photoreceptors was mounted on an electrophotographic process cartridge for an image forming apparatus IMAGIO NEO753 (from Ricoh Co., Ltd.), and a running test which continuously produces image on 300,000 sheets of an A4-size paper (MY PAPER from NBS Ricoh) was performed. Before and after the running test, the photoreceptors were subjected to measurements of abrasion depth and transfer rate, and evaluation of image quality as follows.

Measurement of Transfer Rate

Transfer rate was calculated from the following equation:

$$\text{Transfer rate} = 1 - R$$
$$= 1 - \{R(M/A)/I(M/A)\}$$

wherein R represents the ratio of toner particles remaining on a photoreceptor without being transferred, R(M/A) represents the weight per unit area of the toner particles remaining on a photoreceptor without being transferred, and I(M/A) represents the weight per unit area of initial toner particles on a photoreceptor.

An image chart including multiple solid-image portions each having an area of 2 $cm^2$ was produced with toner on the photoreceptor and transferred onto a transfer paper. The image forming operation was stopped immediately after the toner was transferred onto the transfer paper, while some toner particles were not transferred and remaining on the photoreceptor. Such toner particles remaining on the photoreceptor were adhered to an adhesive tape to determine the weight per unit area of the remaining toner particles (R(M/A)). Specifically, the weight per unit area M/A is determined from the complied data regarding the relation between image density and toner quantity. The weight per unit area of the initial toner particles (I(M/A)) on the photoreceptor was determined by measuring the weight of toner particles before being transferred.

Measurement of Abrasion Depth

After the running test, the photoreceptor was taken out of the image forming apparatus and subjected to measurement of film thickness to determine abrasion depth. The film thickness was measured by an eddy current film thickness meter FISCHERSCOPE MMS (from Fischer).

Evaluation of Image Quality

Before and after the running test, the test chart No. 3 available from The Imaging Society of Japan was printed and its image quality was evaluated by visual observation. Image quality was graded into the following four levels.

A: Very good

B: Good

C: Poor

D: Very poor

The results are shown in Table 4.

TABLE 4

| | Initial Transfer Rate (%) | Initial Image Quality | Transfer Rate after Running Test (%) | Image Quality after Running Test | Abrasion Depth (μm) |
|---|---|---|---|---|---|
| Ex. 1 | 97.2 | A | 97.1 | A | 0.3 |
| Ex. 2 | 97.4 | A | 97.2 | A | 0.4 |
| Ex. 3 | 97.7 | A | 97.3 | A | 0.5 |
| Ex. 4 | 98.7 | A | 98.5 | A | 0.5 |
| Ex. 5 | 98.5 | A | 98.3 | A | 0.4 |
| Ex. 6 | 98.3 | A | 97.9 | A | 0.4 |
| Ex. 7 | 95.1 | A | 92.1 | B | 1.2 |
| Ex. 8 | 94.9 | A | 92.5 | B | 1.1 |
| Ex. 9 | 96.2 | A | 93.6 | B | 1.0 |
| Ex. 10 | 96.5 | A | 93.4 | B | 1.4 |
| Ex. 11 | 94.2 | A | 92.5 | B | 0.7 |
| Ex. 12 | 95.2 | A | 93.3 | B | 0.8 |
| Ex. 13 | 95.8 | A | 92.9 | B | 0.9 |
| Ex. 14 | 94.8 | A | 93.4 | B | 1.0 |
| Ex. 15 | 95.6 | A | 92.7 | B | 0.5 |
| Ex. 16 | 94.8 | A | 93.7 | B | 0.4 |
| Ex. 17 | 96.6 | A | 93.9 | B | 0.3 |
| Ex. 18 | 96.1 | A | 95.7 | B | 0.5 |
| Ex. 19 | 94.0 | A | 92.4 | B | 0.8 |
| Ex. 20 | 97.0 | A | 95.5 | B | 1.4 |
| Ex. 21 | 95.1 | A | 93.1 | B | 0.8 |
| Ex. 22 | 97.3 | A | 94.7 | B | 1.0 |
| Comp. Ex. 1 | 91.9 | A | 90.6 | D | 1.0 |
| Comp. Ex. 2 | — | — | — | — | — |
| Comp. Ex. 3 | 92.4 | A | 91.1 | D | 1.5 |

TABLE 4-continued

| | Initial Transfer Rate (%) | Initial Image Quality | Transfer Rate after Running Test (%) | Image Quality after Running Test | Abrasion Depth (μm) |
|---|---|---|---|---|---|
| Comp. Ex. 4 | 92.9 | A | 89.7 | D | 1.5 |
| Comp. Ex. 5 | 92.6 | A | 90.7 | D | 1.4 |
| Comp. Ex. 6 | 91.8 | A | 90.0 | D | 1.3 |
| Comp. Ex. 7 | 92.1 | A | 90.3 | D | 8.8 |

In Comparative Examples 1, 3, 4, 5, and 6, a considerable amount of white spots was observed in the produced images. In Comparative Examples 1, 3, 4, 5, and 6, paper powders and adhesives released from toner were observed on the photoreceptor. In Comparative Example 7, the abrasion depth was very large. In Comparative Example 2, the resulting film was considerably rough and nonuniform, which was not eligible for the evaluation. In Comparative Example 8, a slight amount of white spots was observed in the produced images. In Examples 7 to 22, image quality deteriorates after the running test only slightly.

Comparative Example 1 and Examples show that the hardened protective layer 33 formed from the radical-polymerizable compound (A) having a charge transport structure and the radical-polymerizable compound (B) having an adamantane skeleton has high repellency. Comparative Examples 3, 4, 5, and 6 and Examples show that adamantane skeleton provides better repellency and abrasion resistance than the other cyclic structures. Moreover, fluorine-containing adamantane skeleton provides much better repellency.

When the radical-polymerizable compound (B) having an adamantane skeleton and the tri- or more functional radical-polymerizable compound (C) are used in combination, repellency is more improved. In particular, the ratio of the molecular weight to the number of functional groups of the tri- or more functional radical-polymerizable compound (C) is 250 or less, abrasion resistance is more improved.

Examples 11 and 12 show that the radical-polymerizable compound (A) having a charge transport structure represented by the formula (3) provides better repellency and abrasion resistance.

Comparative Example 8 and Examples 1 to 6 show that an adamantane skeleton having a radical-polymerizable functional group provides better repellency and mechanical durability.

Additional modifications and variations of the present invention are possible in light of the above teachings. It is therefore to be understood that within the scope of the appended claims the invention may be practiced other than as specifically described herein.

What is claimed is:

1. An electrophotographic photoreceptor, comprising:

a conductive substrate;

a photosensitive layer located overlying the conductive substrate; and a hardened protective layer located overlying the photosensitive layer, the hardened protective layer comprising a hardened material of a hardenable composition comprising a radical-polymerizable compound (A) having a charge transport structure and a radical-polymerizable compound (B) having an adamantane skeleton, wherein the hardened protective layer is the form of a three-dimensional network.

2. The electrophotographic photoreceptor according to claim 1, wherein the adamantane skeleton includes a fluorine atom.

3. The electrophotographic photoreceptor according to claim 1, wherein the radical-polymerizable compound (B) having an adamantane skeleton is monofunctional or difunctional.

4. The electrophotographic photoreceptor according to claim 3, wherein the hardenable composition further comprises a tri- or more functional radical-polymerizable compound (C).

5. The electrophotographic photoreceptor according to claim 4, wherein a ratio of a molecular weight to a number of functional groups of the tri- or more functional radical-polymerizable compound (C) is 250 or less.

6. The electrophotographic photoreceptor according to claim 4, wherein a weight ratio of the radical-polymerizable compound (B) having an adamantane skeleton to a total of the radical-polymerizable compound (B) having an adamantane skeleton and the tri- or more functional radical-polymerizable compound (C) is 0.2 to 0.9.

7. The electrophotographic photoreceptor according to claim 1, wherein the radical-polymerizable compound (A) having a charge transport structure comprises at least one of the following compounds (3) and (4):

(3) (1)

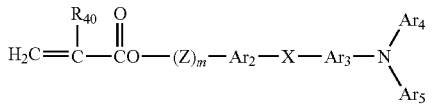

(4) (2)

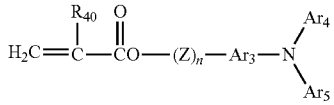

wherein $R_{40}$ represents a hydrogen atom, a halogen atom, an alkyl group, an aralkyl group, an aryl group, a cyano group, a nitro group, an alkoxy group, —$COOR_{41}$ ($R_{41}$ represents a hydrogen atom, an alkyl group, an aralkyl group, or an aryl group), a halogenated carbonyl group, or —$CONR_{42}R_{43}$ (each of $R_{42}$ and $R_{43}$ independently represents a hydrogen atom, a halogen atom, an alkyl group, an aralkyl group, or an aryl group); each of $Ar_2$ and $Ar_3$ independently represents an arylene group; each of $Ar_4$ and $Ar_5$ independently represents an aryl group; X represents a single bond, an alkylene group, a cycloalkylene group, an alkylene ether group, an oxygen atom, a sulfur atom, or a vinylene group; Z represents an alkylene group, an alkylene ether group, or an alkylene oxycarbonyl group; and each of m and n independently represents an integer of 0 to 3.

8. An image forming apparatus, comprising:

the electrophotographic photoreceptor according to claim 1;

a charger to charge a surface of the electrophotographic photoreceptor;

an irradiator to irradiate the charged surface of the electrophotographic photoreceptor to form an electrostatic latent image thereon;

a developing device to develop the electrostatic latent image into a toner image; and a transfer device to transfer the toner image from the electrophotographic photoreceptor onto a transfer medium.

9. The image forming apparatus according to claim 8, wherein the transfer medium is paper.

10. A process cartridge detachably attachable to image forming apparatus, comprising:

the electrophotographic photoreceptor according to claim 1; and at least one of a charger, an irradiator, a developing device, a transfer device, and a cleaning device.

* * * * *